US006047534A

United States Patent [19]

Tanaka et al.

[11] Patent Number: 6,047,534

[45] Date of Patent: Apr. 11, 2000

[54] STOPPING AND RESTARTING DEVICE IN INDEPENDENT DRIVEN SPINDLE IN SPINNING MACHINE

[75] Inventors: Yutaka Tanaka, Gifu; Ryoji Asakawa, Nishikasugai-gun; Susumu Suzuki, Ichinomiya, all of Japan

[73] Assignee: Howa Machinery, Ltd., Nagoya, Japan

[21] Appl. No.: 09/006,655

[22] Filed: Jan. 13, 1998

[30] Foreign Application Priority Data

Jan. 14, 1997 [JP] Japan ..... 9-017346

[51] Int. Cl.[7] ..... D01H 13/18

[52] U.S. Cl. ..... 57/88; 57/100; 318/275; 318/371

[58] Field of Search ..... 57/78, 88, 89, 57/100; 112/271, 277; 318/275, 277, 371; 477/21, 23

[56] References Cited

U.S. PATENT DOCUMENTS

| | | | |
|---|---|---|---|
| 4,375,149 | 3/1983 | Hartmannsgruber | 57/81 |
| 4,420,926 | 12/1983 | Remontet | 57/100 |
| 4,817,371 | 4/1989 | Wolf | 57/100 |
| 4,918,911 | 4/1990 | Grau et al. | 57/100 |
| 5,044,149 | 9/1991 | Grau et al. | 57/88 |
| 5,099,639 | 3/1992 | Grau et al. | 57/88 |
| 5,417,047 | 5/1995 | Locatelli | 57/89 |
| 5,572,859 | 11/1996 | Derichs et al. | 57/100 |

FOREIGN PATENT DOCUMENTS

| | | |
|---|---|---|
| 0 371 214 | 6/1990 | European Pat. Off. . |
| 0 456 996 | 11/1991 | European Pat. Off. . |
| 0 806 501 | 11/1997 | European Pat. Off. . |
| 41 06 953A1 | 9/1992 | Germany . |
| 1-306629 | 12/1989 | Japan . |
| 02 139429 | 5/1990 | Japan . |
| 2-160934 | 6/1990 | Japan . |
| 5-247738 | 9/1993 | Japan . |
| 6-57549 | 3/1994 | Japan . |
| 6-53981 | 7/1994 | Japan . |
| 6-53982 | 7/1994 | Japan . |

*Primary Examiner*—William Stryjewski
*Attorney, Agent, or Firm*—Finnegan, Henderson, Farabow, Garrett & Dunner, L.L.P.

[57] ABSTRACT

Regarding an independently driven type spindle in a spinning machine, when a yarn breakage is occurred in a spindle 10, a brake operating member 35 of the spindle 10 is moved toward a spindle shaft 13. During the movement of the brake operating member 35, control surfaces 49 of the brake operating member 35 cause the stop/restart switches 46 and 47 to be made OFF between the electric driving motor 20 and alternate current lines S and T, thereby causing the motor 20 to be rotated under its own momentum. Then, braking parts 34 of the brake operating member 35 is pressed to the outer peripheral surface of the spindle shaft 13, thereby executing a mechanical braking operation. After the withdrawal of an end of broken yarn, the brake operating member 35 is released, so that a force of the springs 41 causes the brake operating member 35 to be detached from the spindle shaft 13, thereby canceling the braking operation. The movement of the brake operating member 35 also causes the stop/restart switches 46 and 47 to be made ON, thereby restarting the drive motor 20.

17 Claims, 26 Drawing Sheets

STOPPING AND RESTARTING DEVICE IN INDEPENDENT DRIVEN SPINDLE IN SPINNING MACHINE

BACKGROUND OF THE INVENTION

1. Field of the Invention

The present invention relates to a spinning machine such as a ring fine spinning frame or a ring twisting machine having driving motors for driving respective spindles independently. In particular, the present invention relates to stopping and restarting such a spinning machine for use when a yarn breakage occurs.

2. Description of Related Art

Known in a prior art is a ring fine spinning frame wherein a plurality of spindles for winding yarn are independently connected to respective driving motors. In the fine spinning frame having such an independent spindle driving system, all of the spindles in the fine spinning frame are usually subjected to a simultaneous rotating movement by respective driving motors. On the other hand, switches to selectively stop and restart the drive motors are also independently provided for the respective spindles. Thus, upon an occurrence of a yarn breakage in a spindle, a switch of the corresponding spindle is turned OFF by an operator, so that a drive motor of the corresponding spindle is stopped in order to allow the operator to execute a piecing operation on the broken yarn. After the execution of the piecing, the corresponding switch is turned ON by the operator, which allows the corresponding spindle to be restarted. See, for example, Japanese Unexamined Patent Publication (Kokai) No. 6-57549.

As another related art, Japanese Unexamined Patent Publication (Kokai) No. 2-160934 discloses a fine spinning frame having an independent spindle driving system including independent driving motors for respective spindles, wherein each of the spindles is provided with a stationary braking device for preventing the spindle from being subjected to a torsional force, which otherwise causes the spindle to be rotated in the reverse direction. However, this prior art is not related to the independent stopping of a spindle where a yarn breakage is occurred.

FIG. 32 shows, schematically, a spindle to spindle based driving system in the prior art, where spindles SP are provided, independently, with electric driving motors which are grouped. M1 to M6 are driving motors in one of such groups. In other words, each group includes six motors. Control circuits S1 to S6 are provided for independent stop/restart operation of the driving motors M1 to M6 in the group. These control circuits S1 to S6 for the driving motors M1 to M6 in each group are combined as a single control circuit board S0. The driving motors are, generally, driven by a three phase alternating current, while a direct current is employed for obtaining a braking operation for stopping the driving motors. Thus, the control circuit boards between the groups are connected to an alternating current source AC via connectors X and alternating current lines L1 and are connected to a direct current source DC via connectors X and direct current lines L2. Furthermore, switches SW1 to SW6 are provided for the respective spindles and the control circuits S1 to S6 are constructed by sequential circuits including relays with contacts. The relays are operated by switches SW1 to SW6 in such a manner that the connection of the electric motors to the alternating current source causes the electric motors to be disconnected from the direct current source while the connection of the electric motors to the direct current source causes the electric motors to be disconnected from the alternating current source.

In the prior art as explained above, the control circuits S1 to S6 corresponding to the spindle of a predetermined number in a group are combined to a single circuit board S0. However, in a fine spinning frame, the total number of the spindle may be up to several hundred, which causes the total number of the control circuit board S0 to be correspondingly increased. Furthermore, as explained above with reference to FIG. 32, each of the control circuit board S0 is connected to a total of five lines, three three-phase alternating current lines L1 and the two direct current lines L2. As a result, a total number of the connecting points constructed by the connectors X is highly increased, which results in an increase in the chance of occurrence of electrically imperfect connection, thereby reducing the reliability of an operation of the textile machine, such as a reduced reliability in the braking operation. Furthermore, a direct current is employed for executing the braking function, which makes it necessary to provide, in addition to the alternating electric current source AC, the direct electric current source DC. In addition, each of the spindles must be provided with a control sequence circuit for obtaining a reliable switching operation between the alternating current and the direct current, which increased the production cost of the control circuit S0, i.e., the cost of production of the spinning machine.

SUMMARY OF THE INVENTION

An object of the present invention is to provide, in a spinning machine of a spindle to spindle based driving system, an apparatus for a stop/restart of a spindle, capable of reducing the number of points for an electrical connection, thereby enhancing the reliability of operation while reducing the production cost. Another object of the present invention is to provide a spindle having a capability of stopping and restarting.

In order to attain the above object, an apparatus is provided in a fine spinning frame for stopping an independently driven spindle in a spinning machine having spindles having independent electric drive motors for the respective spindles where each of the drive motors is fed by alternate current lines, characterized in that the spindle includes a braking device for executing a mechanical braking operation on the spindle where a yarn breakage has occurred and a stop/restart switch which is for merely switching ON or OFF the connection of the drive motor, of the spindle where the yarn breakage has occurred, with said alternating current lines.

According to this construction, as a braking of the spindle is executed by the mechanical brake action, unlike the DC brake as in the prior art, it is possible to eliminate at least a DC power source, DC power source lines, electrical connections to the DC power source and a circuit for controlling a switching action between the AC and DC power sources, whereby the device can be produced at a lower cost and operative at a higher reliability with less electrical troubles even though a mechanical stop/restart mechanism is adopted instead of the eliminated parts.

Preferably, the braking device brakes a spindle shaft due to a frictional resistance applied on both sides of the spindle shaft relative to a spindle axis. More preferably, a braking load is applied to the spindle shaft in a direction generally transverse to a rotary axis of the spindle. According to these constitutions, since the braking load is symmetrically applied to the spindle shaft from both sides while interposing the rotary axis of the spindle shaft therebetween, it is possible to prevent an eccentric braking load from being generated relative to the spindle shaft even though the spindle shaft is liable to vibrate in structure, whereby the spindle shaft is made to stop smoothly while maintaining a gap between the rotor and the stator of the drive motor at a predetermined distance. Particularly, when the device is adapted to apply the braking load to the spindle shaft generally transverse to the rotary axis of the spindle, it is possible to minimize a force added to members for supporting the spindle shaft and suppress the generation of vibration.

Preferably, the braking device and the stop/restart switch are so associated with each other that, by actuating the braking device, the stop/restart switch disconnects the AC power source lines from the drive motor and the spindle shaft is braked. According to this constitution, the operability is improved because the stop/restart switch is operated together with the actuation of the braking device. In addition thereto, preferably, the braking device and the stop/restart switch are so associated with each other that, by releasing the braking action of the braking device, the stop/restart switch connects the AC power source lines with the drive motor, or the braking device and the stop/restart switch are so associated with each other that, even if the braking action of the braking device is released, the stop/restart switch holds the connection of the AC power source lines with the drive motor, and thereafter, by returning the braking device to a waiting position, the stop/restart switch disconnects the AC power source lines from the drive motor. According thereto, the operability is also improved when the spindle is restarted again as in a case when the spindle is braked.

Concretely, the braking device comprises a brake-operating member movable between a braking position and a waiting position, a brake section to be brought into press contact with the spindle shaft by the movement of the brake-operating member in the braking direction, and an actuator section for operating the stop/restart switch interposed between the AC power source lines and the drive motor.

A spindle according to the present invention is characterized in that a housing of a drive motor for driving a spindle shaft of the spindle is provided with a braking device for mechanically braking the spindle shaft and a stop/restart switch for merely opening/closing the connection between the drive motor and the AC power source lines. Since the spindle is structured as a unit together with the braking device and the stop/restart switch, the installation thereof becomes easy.

Preferably, also in this spindle, the braking device and the stop/restart switch are so associated with each other that, by actuating the braking device, the stop/restart switch disconnects the AC power source lines from the drive motor, whereby the operability is enhanced. For example, the braking device comprises a brake-operating member movable between a braking position and a waiting position, a brake section to be brought into press contact with the spindle shaft by the movement of the brake-operating member in the braking direction, and an actuator section for operating the stop/restart switch interposed between the AC power source lines and the drive motor, wherein the actuator section holds the stop/restart switch in the OFF state to disconnect the AC power lines from the drive motor even if the braking action due to the brake section is released, and, by returning the brake-operating member to the waiting position, cancels the holding action of the stop/restart switch.

Preferably, the brake-operating member having a bifurcate front end nipping the spindle shaft is mounted to the housing to be rotatable upward and downward, and the brake sections provided at the front end of the brake-operating member are brought into contact with a flange of the spindle shaft to apply a downward pressure onto an upper surface thereof in the axial direction of the spindle shaft, whereby the generation of eccentric braking load is further effectively suppressed.

Also, according to the present invention, the braking device for mechanically braking the spindle shaft of the single drive spindle is of a portable type. Since the braking device is of a portable type, it is unnecessary to provide the braking devices in the respective spindles, which results in the reduction of the number of parts. Thus, the troublesome installing operation is eliminated and a chance of machine trouble is minimized.

The portable type braking device preferably has a engagement member detachably engageable with the single drive spindle and a brake-operation member having a brake section to be in press contact with the spindle shaft, wherein the brake section is brought into press contact with the spindle shaft while the engagement member is engaged with the engagement section of the single drive spindle. According to this structure, since the brake-operating member itself forms a braking device, it is possible to reduce the number of parts as well as a weight of the portable type braking device, which is suitable for the portable type. The portable type braking device preferably has an actuator section capable of actuating a stop/restart switch interposed between the AC power source lines and the drive motor when the engagement member is engaged with the single drive spindle. Since the stop/restart switch is actuated by the engagement operation of the portable type braking device according to this structure, the operability is facilitated.

BRIEF EXPLANATION OF ATTACHED DRAWINGS

DESCRIPTION OF PREFERRED EMBODIMENTS

Figure 1:
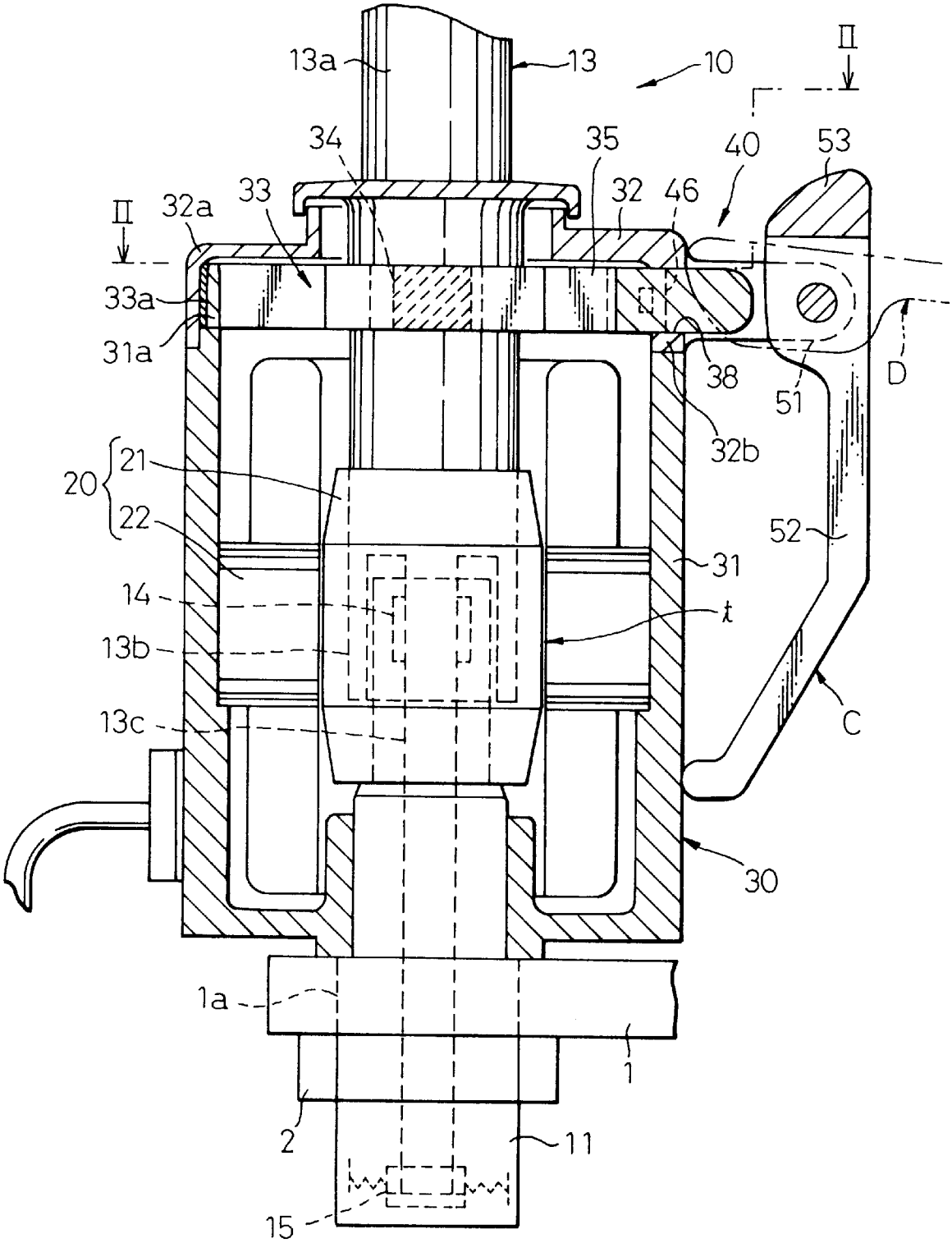
FIG. 1 is a side sectional view of a single drive spindle.

In FIG. 1, a spindle rail 1 is arranged along a front side of a machine frame of a ring fine spinning frame. A plurality of independently driven spindles (below, spindles) 10, which are arranged at a predetermined spacing along the length of the machine frame, are mounted on the spindle rail 1. Each of the spindle 10 has a bolster 11, which is inserted to a mounting hole 1*a* formed in the spindle rail 1 and is fixedly connected thereto by means of a nut 2. In each of the independently driven spindles 10, an electric driving motor 20 is provided, which has a motor housing 30, which is made integral with respect to the bolster 11.

The spindle 10 has a shaft 13 provided with a bobbin insert part 13*a* to which a bobbin (not shown) is inserted, a base part 13*b*, which extends downwardly from the part 13*a* and a small diameter part 13*c*, which is coaxial with the shaft 13 and extends downwardly from the base part 13*b*. The small diameter part 13*c* is, at its top and bottom ends, rotatably supported to the bolster 11 by means of vertically spaced set of bearing units 14 and 15, while allowing the spindle shaft 13 to be removed upwardly. The lower bearing unit 15 is constructed by members which are able to move radially and urged radially inwardly toward the axis of the spindle by a suitable means, so that a kind of a damper is created which functions to absorb a vibration during a high speed rotating movement of the spindle shaft 13, thereby suppressing an operational noise. Namely, due to this construction, the spindle is able to swing about the upper bearing unit 14, which functions as a fulcrum.

The drive motor 20 includes, in addition to the housing 30, a rotor 21, which is fixedly arranged around the base portion 13*b* of the spindle shaft 13, and a stator 22, which arranged inside of the housing 30. A spacing t exists between the rotor 21 and the stator 22 for an effective rotating movement.

The housing 30 is formed as an assembly constructed by a body 31 having a space therein for storing the motor 20 and a cover 32 in which a part of a braking device 40 according to present invention as well as stop/restart switches 46 and 47 are housed.

Figure 2:
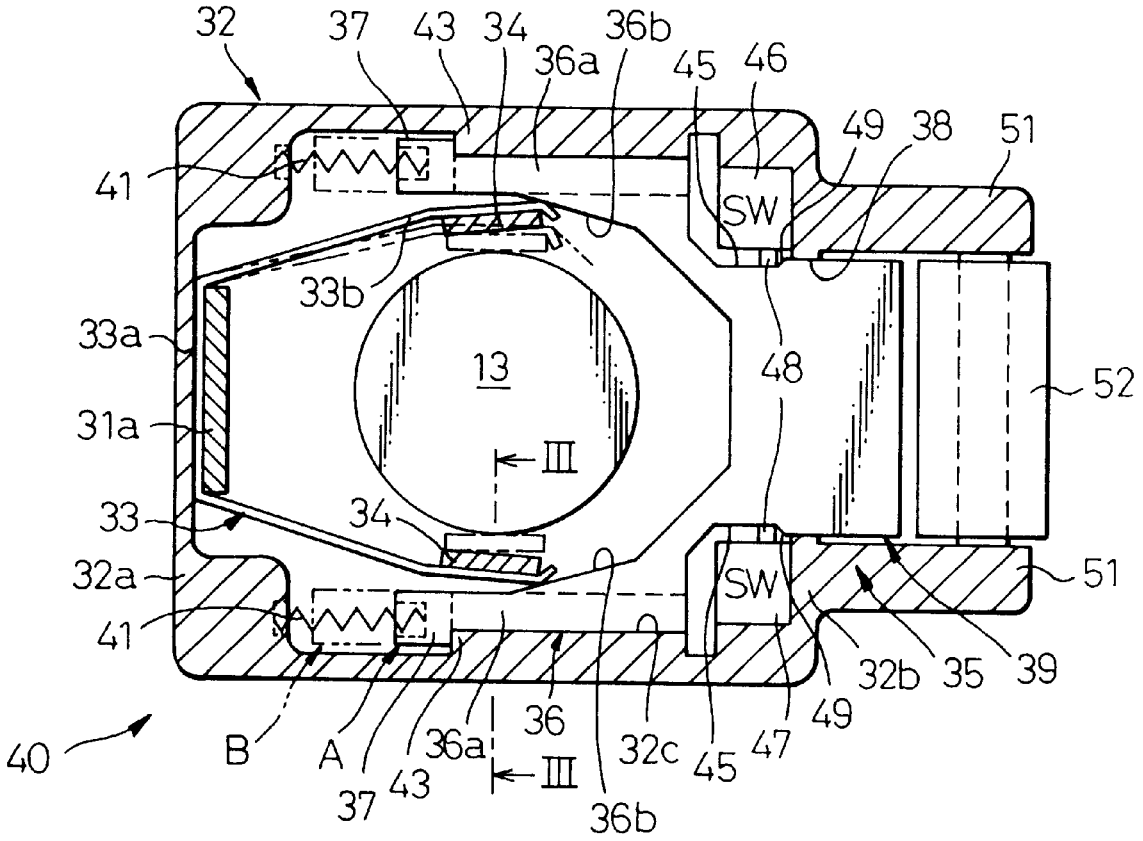
FIG. 2 is a sectional view taken along line II—II in FIG. 1.

As shown in FIG. 2, the braking device 40 includes a shoe holder member 33 formed as a resilient member such as a flat spring of a substantially C-shape and a brake operating member 35 for causing a braking operation to be executed. The shoe holder member 33 has a base portion 33*a*, which is sandwiched between a front wall 32*a* of the cover 32 and a front wall 31*a* of the body 31 and a pair of arm (bifurcated) portions 33*b*, between which the spindle shaft 13 is arranged in such a manner that the portions 33*b* are urged radially outwardly from the shaft 13 under the action of the spring force of the holder itself, while the portions 33*b* are moved radially inwardly toward the shaft 13 against the force of the spring. Furthermore, at the ends of the arm portions 33*b*, braking parts (brake shoes) 34, which are located at diametrically spaced positions with respect to the spindle shaft 13, are integrally formed. When the brake shoes 34 are under a pressed condition with respect to the surface of the spindle shaft 13, a frictional resistance force is generated, which cause the spindle to be subjected to a braking operation.

Figure 3:
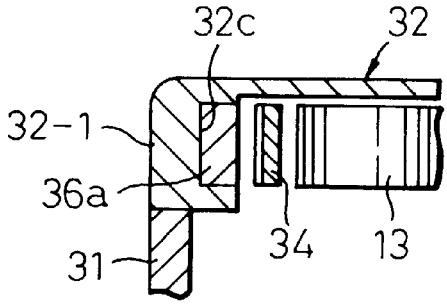
FIG. 3 is a sectional view taken along line III—III in FIG. 2.

As shown in FIG. 2, the brake operating member 35 is formed with a bifurcated portion 36 constructed by a pair of arms 36*a* having ends located between a side wall of the arm portions 33*b* of the holder member 33 and a side wall of the cover 32. Furthermore, each of the arms 36*a* is, at its end, formed with a hook shaped catch portion 37, which is opened outwardly. The brake operating member 35 has, at its rear side opposite the arms 36*a,* a tongue portion 39 of a narrow width, which is inserted to a window 38 of a rectangular shape formed in a rear wall 32*b* of the cover 32 and is projected outwardly therefrom. As shown in FIG. 3, the cover member 32*c* has opposite side walls 32-1 which form guide grooves 32, to which the arms 36*a* of the brake operating member 35 are respectively slidably inserted, so that the member 35 is moved toward and away from the shaft 13. As shown in FIG. 2, between the arms 36*a* of the brake operating member 35 and the inner front wall 32 of the cover member 32, springs 41 are arranged so that the brake operating member 35 is usually moved away from the front wall 32*a* of the cover member 32 in the right-handed direction in FIG. 2. Thus, so long as the brake operating member 35 is not subjected to a pressing force, the catch members 37 are, at their end parts, engaged with respective stopper portions 43 formed in the cover member 32, which results in the catch members 35 being at a waiting position as shown by a solid line A in FIG. 2.

In FIG. 2, the arms 36*a* of the brake operating member 35 are, at the inner sides, inclined surfaces 36*b* which are tapered in a rearward direction. Thus, during a movement of the brake operating member from the waiting position A to a braking position p as shown by dotted lines, the tapered inner surfaces 36*b* of the arms 36*a* of the brake operating member 35 come to a contact with the arm portions 33*b* of the shoe holding member 33, which causes the brake shoes 34 to be moved radially inwardly toward the outer surface of the spindle shaft 13, thereby commencing a braking operation of the spindle shaft 13. Contrary this, a movement of the brake operating member 35 in the opposite direction causes the braking shoes 34 to be detached from the outer surface of the spindle shaft 13 under the resiliency of the shoe holding member 33, which causes the braking operation to be canceled.

As shown in FIG. 2, the brake operating member 36 is, at locations between the arms 36*a* and the narrow width portion 39, formed with operating parts 45 so that the parts 45 are faced with stopping/restart switches 46 and 47 on the cover 32 at positions located outwardly from the narrow wall portion 39 in the direction of the width of the portion 39. Each of the stopping/restart switches 46 and 47 is an ON/OFF type switch having a normally closed inner contact and is formed with an operating member 48, which is spring urged so that the operating member 48 is normally projected outwardly so that the switch takes ON position. When the operating member 48 is pressed inwardly, the switch is moved to the OFF position. The operating parts 45 of the switch operating member 36 selectively cooperate with the operating members 48 of the switches 46 and 47. The operating part 45 is formed with a cam surface (inclined surface) 49 cooperated with the operating member 48. Namely, during the movement of the brake operating member 35 from the waiting position A to the operating position B, the cam surface 49 engages with the operating member 48, which causes the latter to be moved inwardly, which causes the switch to be moved to OFF condition. Contrary to this, during the movement of the brake operating member 35 from the operating position B to the waiting position A, the cam surface 49 is disengaged from the operating member 48, which causes the latter to be projected outwardly, which causes the switch to be moved to ON condition.

As shown in FIGS. 1 and 2, the rear wall 32*b* of the cover 32 has, at its sides, a pair of handle support members 51 projected rearwardly, between which an operating handle 52 is connected in such a manner that the operating handle is rotated between a non-operating position C where the operating handle 52 hangs vertically as shown by a solid line and an operating position D, where the operating handle 52 extends horizontally as shown by a dotted line. The operating handle 52 has a cam part (engaging part) 53 of an arc shaped cross section made of a material of an increased friction such as a rubber. In the rotating movement of the handle 52 from the non-operating position C to the operating position D, the cam portion 53 causes the brake operating member 36 to be moved from the waiting position A to the braking position B against the force of the springs 41. Contrary to this, in an opposite movement of the operating handle 52, the force of the spring causes the brake operating member 36 to be moved back to the waiting position A from the braking position B.

Figure 4:
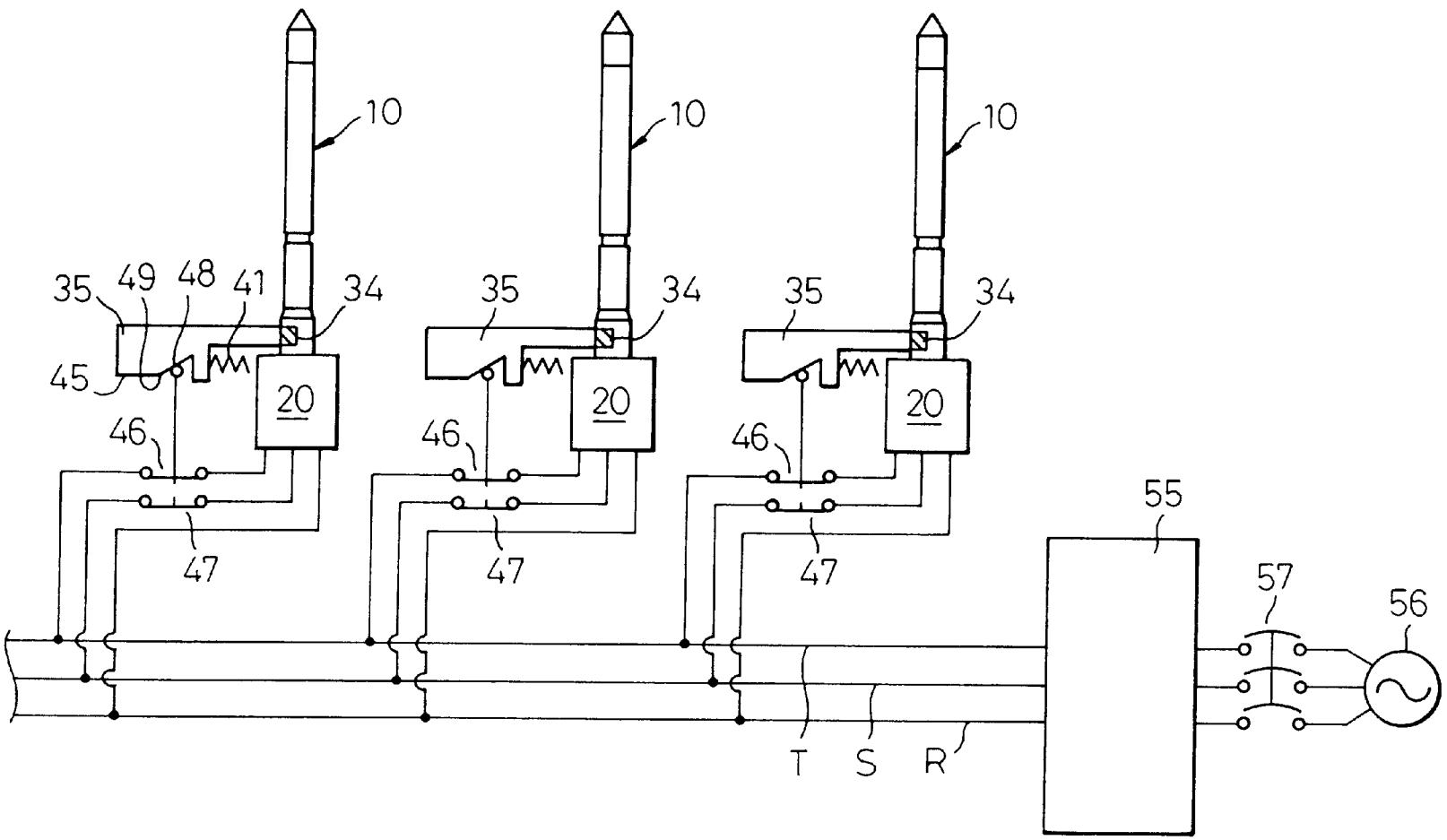
FIG. 4 is a wiring diagram.

FIG. 4 schematically illustrates an electrical connection of the motors 20 and the stop/restart switches 46 and 47 in the respective spindles 10 with respect to alternate current lines R, S and T at an outlet side of a frequency variable control device formed as an inverter device 55, which is, itself, well known. The inverter device 55 is in electrical connection with a three phase alternate current source 56 via a main switch 57. In the alternate current lines R, S and T, the line R is connected directly to the drive motors 20 of the respective spindles 10. The lines S and T are connected to the electric motors 20 via the normally closed contacts of the switches 46 and 47, respectively. In FIG. 4, in the braking apparatus 40, only the brake operating members 35, the switch control surfaces (cam surfaces) 49, the springs 41 and the brake shoes 34 are schematically illustrated. As will be easily understood from this structure, the present invention eliminates a DC source and direct current lines, so that any electric connection regarding the DC lines as well as a switching circuit between the AC current and DC current are not needed, although the mechanical braking devices are additionally needed in the respective spindles. Thus, the present invention makes it possible to avoid troubles which may otherwise be generated by electrical connections. On the other hand, the cost for the provision of the mechanical braking devices is not high and the operation of the mechanical braking device is reliable. Thus, a reliable operation is obtained while keeping a low cost of the system.

Now, an operation of the first embodiment will be explained. The main switch 57 is made ON and a restart switch (not shown) is made ON, which causes the inverter device 55 to commence a frequency control operation in such a manner that a predetermined pattern of a control of a rotating speed of the spindles 10 is obtained. In this case, in all of the spindles 10, the brake operating members 35 of the braking devices 40 are in the respective waiting positions A, i.e., under the brake released conditions, while the restart/stop switches 46 and 47 are made ON, causing all of the alternate current lines R, S and T to be in electrical connection with the motors 20. Thus, a frequency control of the inverter 55 is restarted, which causes, finally, the speed of each of the spindles 10 to be increased to a predetermined steadly spinning speed.

When yarn breakage is occurs at a spindle 10 during its rotating movement, an operator manipulates the operating handle 52 from the non-operating position C to the operating position D. During such a movement of the operating handle 52, the engaging part 53 of the handle 52 pushes the brake operating member 35 at its rear end, so that brake operating member 35 is moved, from the waiting position A, to the braking position B. During the movement of the brake operating member 35 from the waiting position A to the braking position B, the switch control surfaces 49 push the operating members 48 of the switches 46 and 47, respectively, thereby causing the latter to be switched to the respective OFF positions, which causes the respective motors 20 to be disconnected from the alternate current lines S and T, so that any subsequent rotating movement of the motor is done under its own momentum. Furthermore, during the movement of the brake operating member 35 from the waiting position A to the braking position B, the inclined surfaces 36*b* of the brake operating member 35 come to contact with the tip ends of the respective arms 33*b* of the shoe holding member 33, which causes the arms 33*b* to be laterally inwardly moved, so that the brake shoes 34 are pressed to the outer peripheral surface of the spindle shaft 13. Thus, when the braking position B of the brake operating member 35 is obtained, a mechanical braking is generated on the spindle shaft 13 subjected to the momentum driven rotating movement, resulting in a quick stoppage of the spindle shaft 13. A locking of the brake operating member 35 to the braking position B is obtained due to the fact that the engaging part 53 is under a frictional engagement with the rear end of the brake operating member 35. In short, according to present invention, the de-energization of the driving motor 20 cooperates with the braking operation, which makes the operation simplified, in comparison with the case where the de-energization of the driving motor and the braking operation are done independently. It should be noted that the braking position B is not permanently fixed. Namely, a factor such as a wear of the shoe 34 causes the position B to vary slightly.

Upon the completion of a stoppage of the spindle shaft 13, a broken end of the yarn is, in a well known manner, withdrawn from the bobbin fitted to the spindle shaft 13, is passed through a traveler (not shown) and a snail wire (not shown), and is held at a location in front of a front draft roller of the fine spinning frame. Then, the operating handle 52 in the locked position D is moved downwardly to the non-operating position C, so that the brake operating member 35 is retracted under the action of the springs 41, so that the brake shoes 34 are detached from the peripheral surface of the spindle shaft 13 under the action of the spring force of the shoe holding member 33, thereby releasing the braked condition, which is followed by a disengagement of the switch control surfaces 49 from the operating members 48 of the switches 46 and 47, so that the latter are switched to the respective ON conditions, resulting in an electrical connection of the alternate current lines S and T to the motor 20. As a result, the electric feeding to the electric motor 20 is commenced, so that the rotating speed of the motor 20 is instantly increased to its designated speed, which is the same as that in the remaining spindles. When the rotating movement of the spindle shaft commenced, an operator effects, in a well known manner, a manual piecing operation, where the drawn end of the yarn is pieced to a fleece of fibers issued from the front roller (not shown) of the fine spinning frame.

Figure 5:
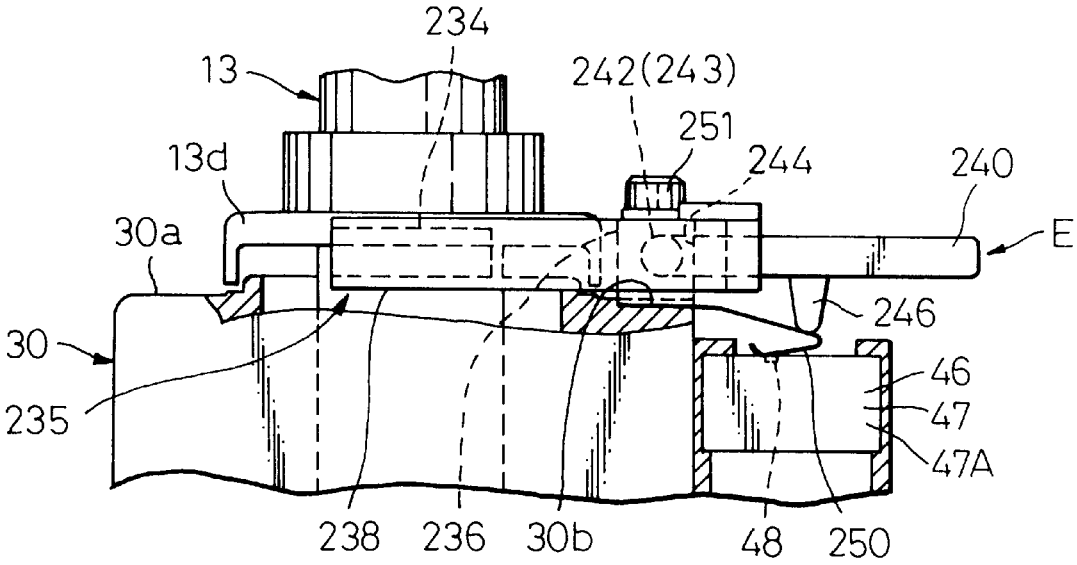
FIG. 5 is a front view of another embodiment.
Figure 6:
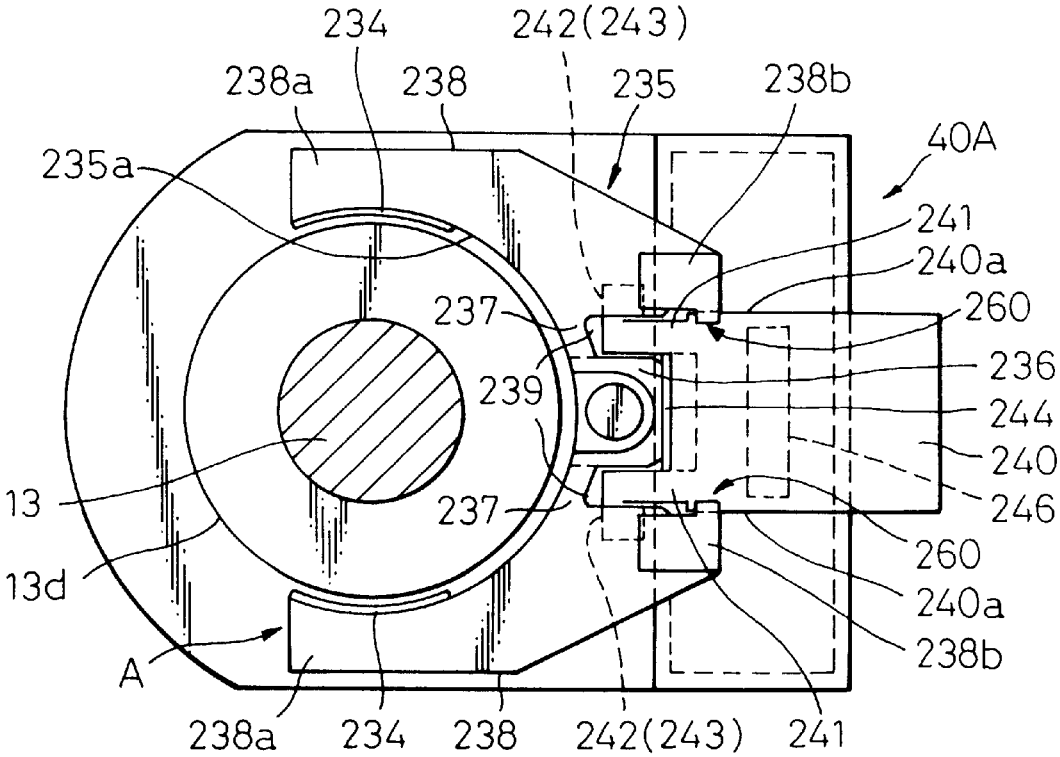
FIG. 6 is as plan view of FIG. 5.

FIGS. 5 to 10 shows a modification of the embodiment of the present invention. Namely, in a brake device 40A in the modification, a brake operating member 235 is constructed as a mounting part 236 of a rectangular shape which is to be connected to an upper surface 30*a* of the housing 30, arm parts 238 located on sides of the part 236 and connecting parts 237 connecting integrally the arm parts 238 with the mounting part 236. The brake operating member 235 includes a inner surface 235*a,* which faces an integral flange part 13*d* of the spindle shaft 13 and encircles the flange part 13*d* over substantially one half of the entire periphery of the flange part 13*d.* Furthermore, the arm parts 238 have free ends 238*a*, which are arranged at diametrically opposite positions with respect to the axis of the spindle shaft 13, while located outwardly from the outer surface of the flange part 13*d.* Brake shoes 234 are connected to the inner surface of the arm parts 238 at their ends. The arm parts 238 have rear ends 238*b* which extend rearwardly from the connection parts 237 while grooves 239 are formed between the rear ends 238*b* and the mounting part 236. The brake operating member 235 is integrally formed from a material having an elasticity such as a synthetic resin. Furthermore, the connecting parts 237 have a portion of a small thickness in the front to back direction over the remaining parts of the brake operating member 235. As a result, when the rear parts 238*b* of the arm portions 238 are widened outwardly, the arms 238 are subjected to an elastic deformation in such a manner that the arms 238 are displaced about the connecting parts 237 as a fulcrum, so that the arms 238 are, at their free ends, moved toward each other. Furthermore, as described later, a construction of the brake operating member 235 is such that, in the condition where the brake operating member 235 is mounted to the housing 30, the brake shoes 234 are held at waiting positions A as shown in FIG. 6 where the brake shoes 234 are spaced from the outer periphery of the flange part 13*d*, when the arms 238 are not subjected to the widening force for increasing the lateral spacing between the arms 238.

Figure 8:
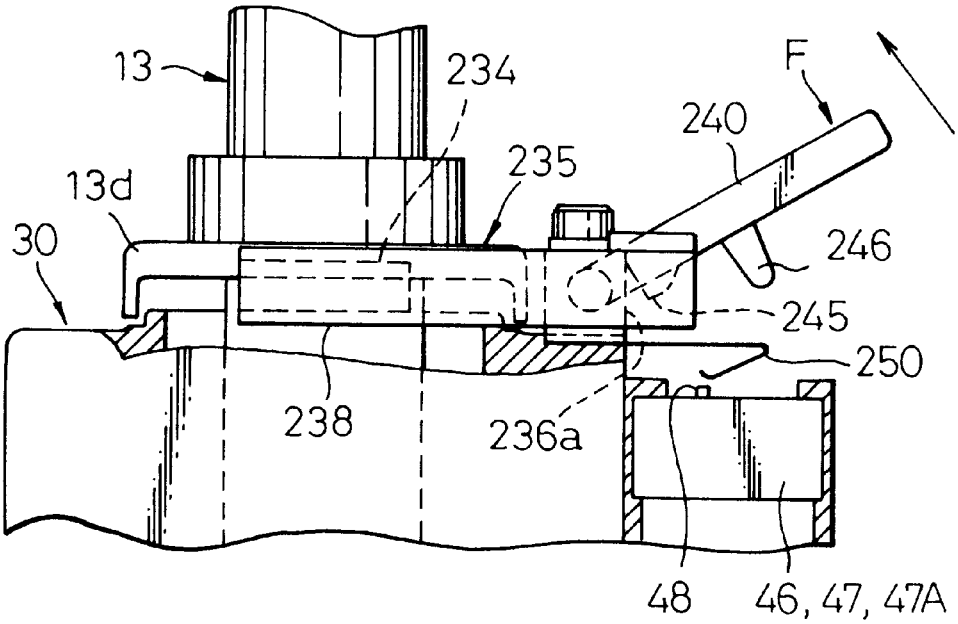
FIG. 8 is a front view showing an operative state.

As shown in FIG. 6, an operating handle 240 is formed as a bifurcated shape constructed by a pair of arms 241, which are inserted into the laterally spaced grooves 239, between which the mounting part 236 is located. Furthermore, each of the arms 241 is formed with a laterally and outwardly projected stub shaft 242, which is rotatably inserted to a corresponding supporting hole 243 formed in the brake operating member 235. As a result of this structure, the operating handle 240 is moved between a horizontal position E as shown in FIG. 5 and an inclined position F as shown in FIG. 8. The operating handle 240 has, at the root portion of the bifurcated shape, a beveled portion 244, which prevents the root portion from interfering with the mounting part 236 when the operating handle 240 is rotated between the horizontal position E and the inclined position F. Furthermore, in order to prevent the operating handle 240 from being rotated below the horizontal position E as shown in FIG. 5, the operating handle is, at a location below the beveled part 244, formed with a abutting surface 245, which is contacted with the mounting portion 236 at its rear surface 236*a*. The operating handle 240 is, at its lower side, integrally formed with an operating projection 246. The operating projection 246 is adapted to press a plate spring 250 which will be explained later in more detail.

In the instant embodiment, in order to allow the electric lines R, S and T to be independently made ON or OFF in the three phase alternate current, stop/restart switches as microswitches 46 and 47 between the electric lines R, S and T and the drive motor 20, similar to the first embodiment, as well as additional stop/restart switch 47A between the electric line R and the drive motor 20 are arranged below the operating projection 246. In this embodiment, these stop/restart switches 46, 47 and 47A are the normally open (OFF) type. When the operating member 48 is pressed, a corresponding inner contact (not shown) is made ON. On the other hand, when the operating member 48 is freed so that the operating member 48 is projected outwardly projected position, the inner contact of the corresponding switch is made OFF.

The plate spring 250 having a hook shaped end is arranged between the operating projection 246 and the stop/restart switches 46, 47 and 47A. The plate spring 250 functions as an operating part which causes the contact operating members of the three switches 46, 47 and 47A to be simultaneously operated. As shown in FIG. 5, the plate spring 250 has a base portion, which is fitted to a recess 30*b* formed at a top surface 30*a* of the housing 30 and which is, together with the mounting part 236 of the brake operating member 235, integrally connected to the housing 30 by means of a bolt 251 screwed from the above to a screw hole in the housing, while maintaining lateral positions of the members 235 and 250 by means of the recess 30*b*. In the three stop/restart switches 46, 47 and 47A, it may be possible that the displacements of the respective operating members 48 for causing the corresponding switches to be made on are slightly different from each other. However, the switching-on of the switches is done by pressing elastically the respective operating member 48 via the plate spring 250, which allows the difference in the displacement to be absorbed, thereby affirming a positive switching operations of the three stop/restart switch.

The brake operating member 235 has a laterally spaced pair of rear parts 238*b,* which have, at the inner surfaces faced with each other, stepped cam surfaces 260, which are constructed by inwardly projected upper cam portions 261 and lower cam portions 262. The lateral spacing between the upper cam portions 261 is narrower than that between the lower cam portions 262. As a result of this structure, a rotating movement of the operating handle 240 between the horizontal position E and the vertical position F causes the operating arms 238 of the brake operating member 235 to be moved between a rest position (non braking position) A in FIG. 6 where a small gap exists between the brake shoes 234 and the outer peripheral surface of the flange portion 13*d* of the spindle 13 and a braking position B in FIG. 9, where the brake shoes 234 are in a press contact with the outer periphery of the flange part 13*d* of the spindle for generating a mechanical braking force in the spindle shaft 13.

On the other hand, the lateral spacing between the lower cam portion 262 is roughly equalized with the lateral width of the operating handle between the side surfaces 240*a*.

Figure 7:
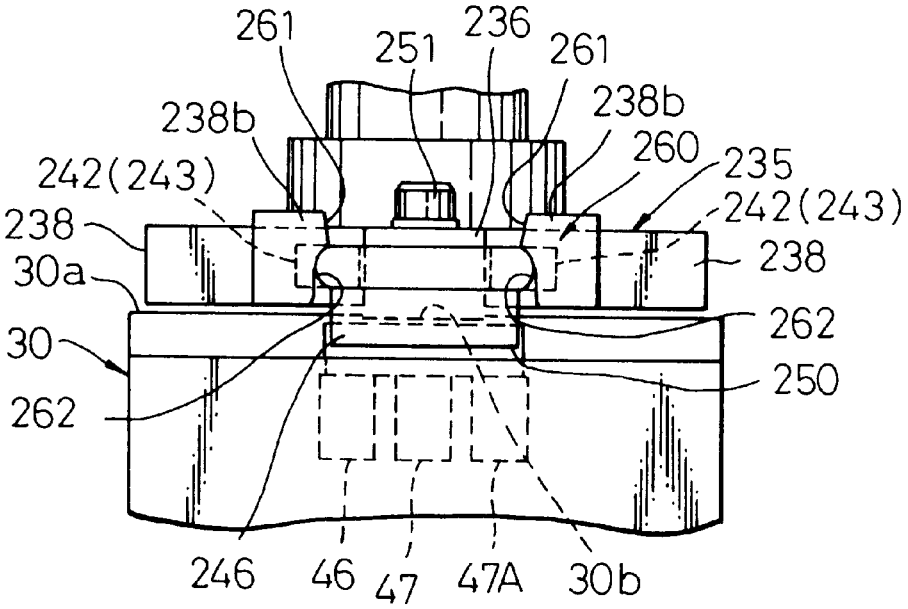
FIG. 7 is a right side view of FIG. 5.
Figure 9:
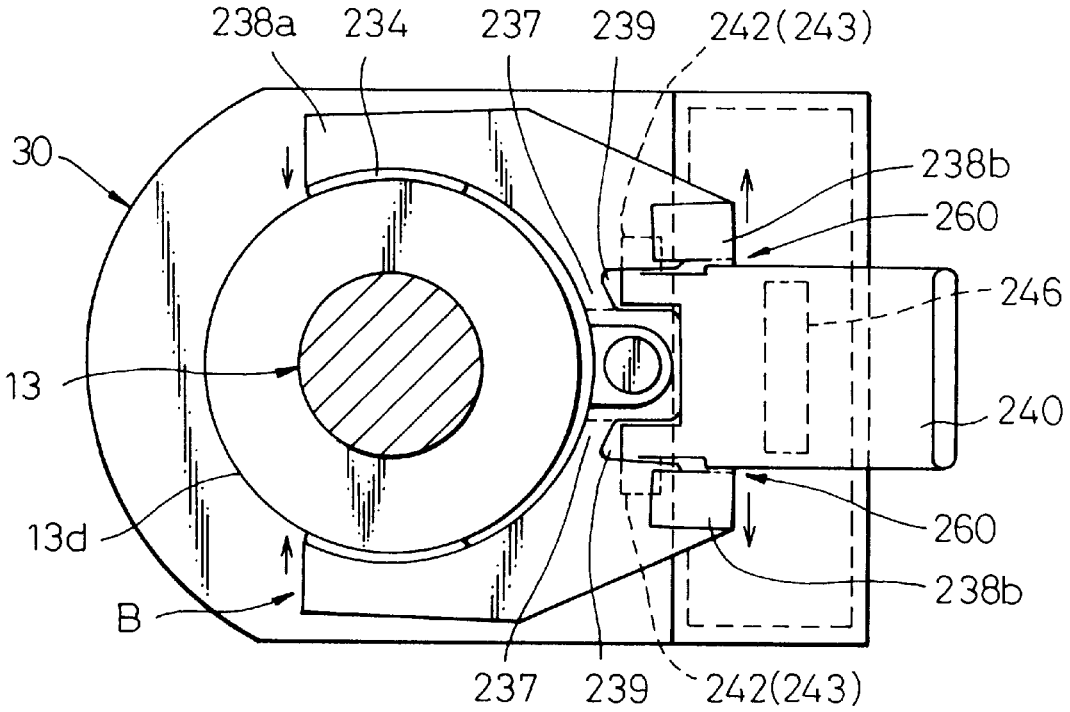
FIG. 9 is a plan view of FIG. 8.
Figure 10:
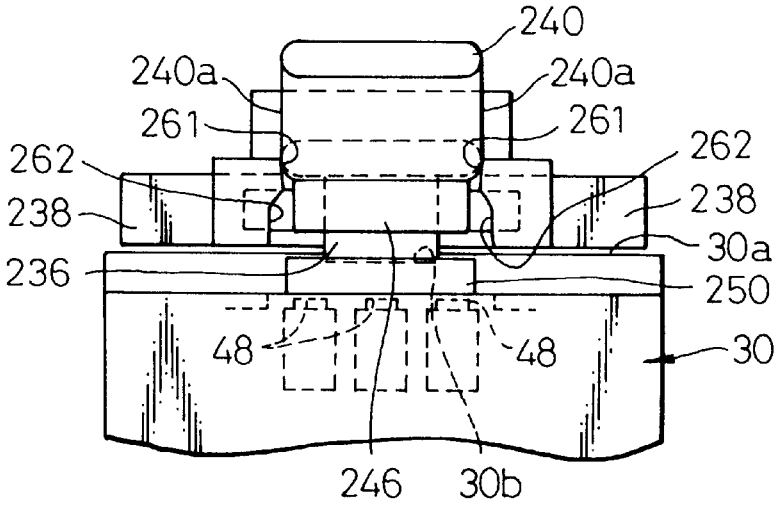
FIG. 10 is a right side view of FIG. 8.

Thus, the operating handle 240 is in the horizontal position E as shown FIG. 5, held between the lower cam portions 262, so that the outwardly opening movement of the rear parts 238*b* of the brake operating member 235 by means of the operating handle 240 is prevented as shown in FIGS. 6 and 7. Contrary to this, the lateral spacing between the upper cam parts 261 is such that a positioning of the side surfaces 240*a* of the handle 240 between the upper cam parts 261 in the inclined position F of the operating handle 240 causes the rear parts 238*b* of the brake operating member 235 to be urged laterally outwardly, which causes the brake shows 234 to be pressed to the flange part 13*d* of the spindle shaft 13 as shown in FIGS. 9 and 10.

When the handle 240 is in the horizontal position E, the plate spring 250 is urged downwardly by means of the operating projection 246, so that the operating members 48 of each of the stop/restart switches 46, 47 and 47A are pressed, which causes the switches to be made ON. In this case, an upwardly directed force applied to the operating handle 240 by means of the plate spring 250 is received at the stepped portion between the upper cam part 261 and the lower cam part 262, which allows the horizontal position E of operating handle 240 to be maintained. As a result, electric motor 20 is maintained to be fed by the three phase alternate current lines R, S and T, thereby keeping a rotating movement of the spindle.

When a yarn breakage in a spindle occurs, an operator moves the operating handle 240 in the corresponding spindle, so that it is rotated to the inclined position F in FIG. 8. Such a movement to the position F causes the plate spring 250 to be displaced from the operating members 48 of the stop/restart switches 46, 47 and 47A, which causes the switches to be made OFF, thereby preventing electric current being fed to the motor 20. Furthermore, the side surfaces 240*a* of the operating handle 240 causes the upper cam parts 261 of the brake operating member 235 to be laterally outwardly opened, which causes the arm portions 238 to be elastically displaced from the rest position A to the operating position B. At the operating position B, the flange portion 13*d* is, at its outer periphery, held between the brake shoes 234, thereby braking the spindle. Then, the operator executes a piecing operation.

After the completion of the yarn piecing operation, the operating handle 240 is returned, from the inclined position F, to the horizontal position E, which allows the spindle 13 to commence a rotating movement, thereby commencing a spinning operation.

In the above mentioned second embodiment, a construction is employed that the brake shoes 234 are moved inwardly in order to make the brake shoes 234 to be made contacted with the spindle shaft 13 at its diametrically opposite locations. Furthermore, the brake shoes 234 at the opposite sides are simultaneously contacted with the peripheral surface of the spindle shaft 13. Thus, the spindle shaft 13 is maintained at a vertically extended position, while a braking force is applied thereto, even in a situation that the spindle 13 is under an arrangement that the spindle 13 is easily shaken. Thus, it is desirable that the situation will not occur where a spindle shaft 13 is inclined or shaken, which causes the gap between the rotor 13 and the stator 22 to be reduced or causes, in a extreme case, the rotor 13 and the stator 22 to be brought into a mutual contact to damage the parts, as is the case when the spindle shaft 13 is subjected to a braking load only at its spindle side. However, the structure in the second embodiment is disadvantageous in that a simultaneous and equalized application of the braking load by the braking shoes 34 to the outer periphery of the spindle shaft 13 is needed, resulting in an increased requirement as to a precision of the parts, since, in the structure in the second embodiment, where a braking load is applied to the outer periphery of the spindle 13 at its diametrically opposite positions in a direction transverse to the axis of the spindle, a generation of an inclination of the spindle shaft 13 is likely even in a situation that a small difference exists between the timings of the application of the brake shoes 34 at the opposite sides to the spindle shaft 13.

Now, a third embodiment according to present invention capable of overcoming the above mentioned difficulty will be explained. In the third embodiment in FIGS. 11 to 14, the electric drive motor 20 is stored in a body 31 of a housing 30 and the spindle shaft 13 is rotatably supported to the housing 30 under the similar damping function. A braking device 140 is provided, which includes a pair of laterally spaced support members 160 mounted on an upper surface of the cover member 32 and a brake operating member 135 of a substantially L shape having an intermediate boss portion 135-1 which is supported rotatably on the support members 160 by means of pins 135-2 in such a manner that the brake operating member 135 is rotated between a rest position A as shown by a solid line in FIG. 11 and a brake operating position B as shown by a dotted line.

Figure 12:
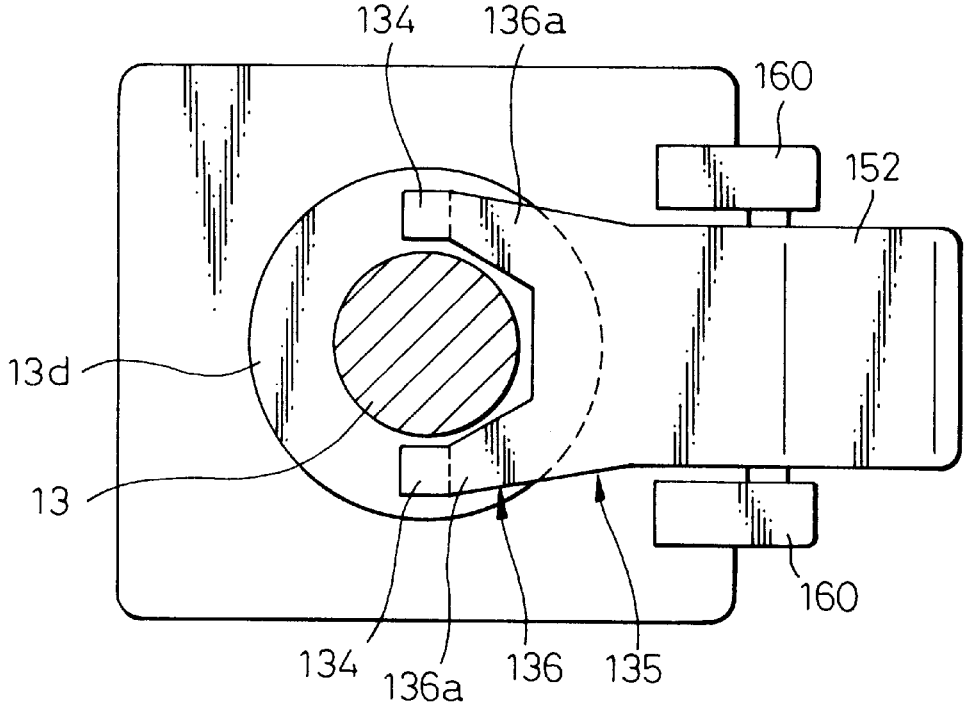
FIG. 12 is a plan view of FIG. 11.

The brake operating member 135 has, at its tip end portion, a bifurcated portion 136 as shown in FIG. 12, which is constructed by a pair of spaced arms 136*a* located on the sides of the spindle shaft 13. Each of the arms 136*a* has a free end, which is provided with, at its lower surface, a braking portion (brake shoe) 134, which is faced with an upper surface of the flange 13*d* of the spindle shaft 13 and which is pressed axially downwardly during the execution of the braking operation. The brake operating member 135 forms, at the opposite end, an operating handle 152.

Figure 11:
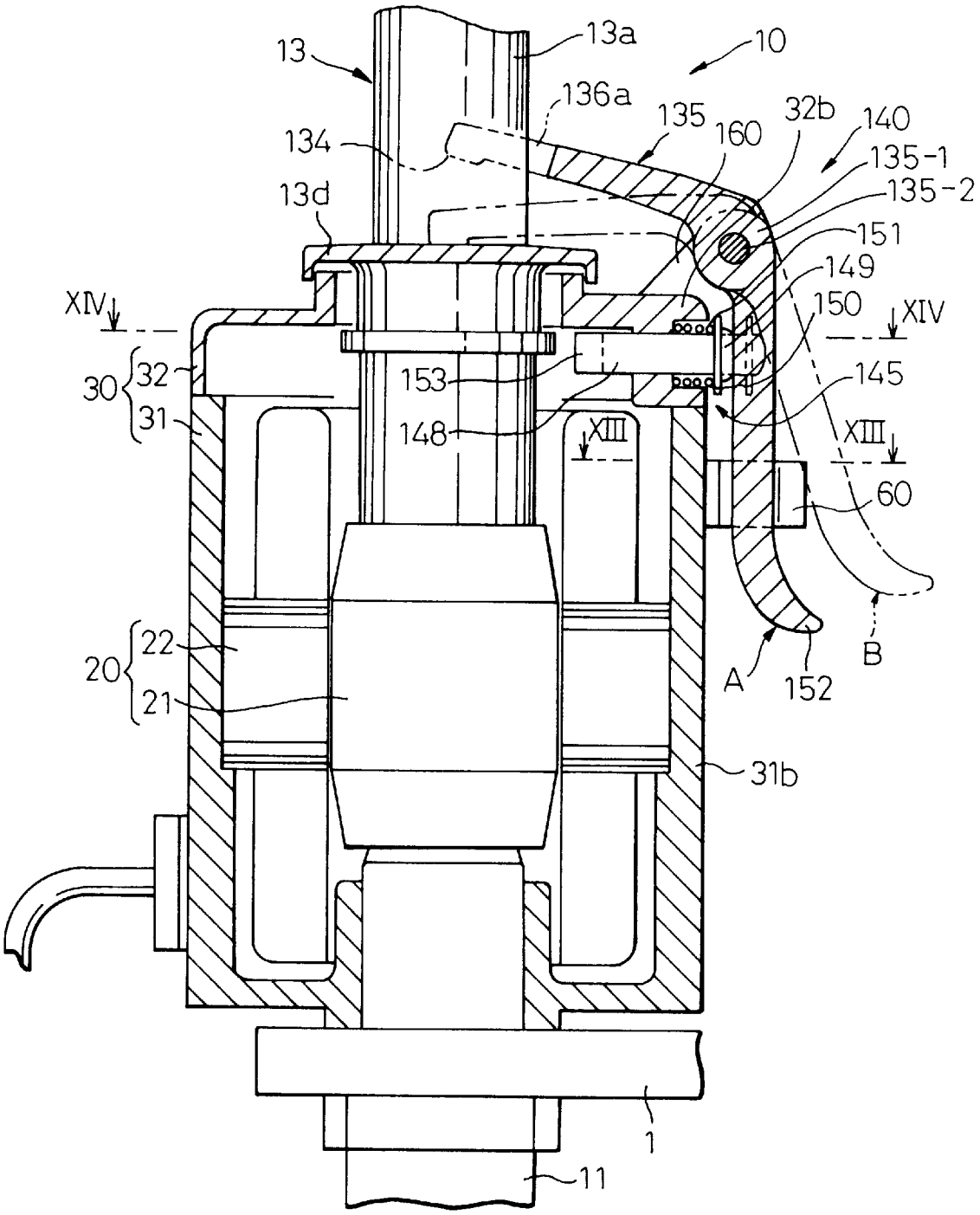
FIG. 11 is a side sectional view showing a further embodiment of a single drive spindle.
Figure 13:
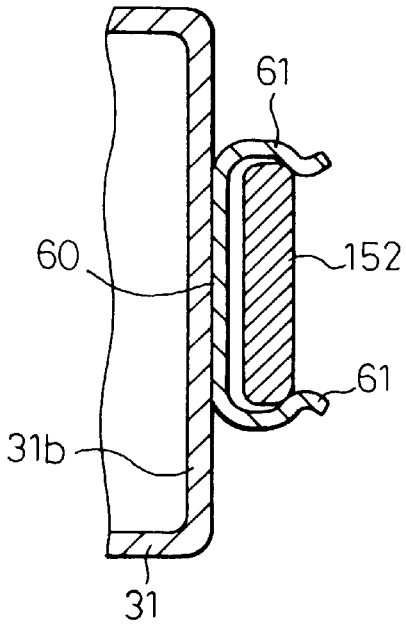
FIG. 13 is a sectional view taken along line XIII—XIII in FIG. 11.

As shown in FIG. 13, a gripper 60 is fixedly connected to an outer surface of the rear wall 31*b* of the housing 31 in such a manner that the operating handle 152 is releasably engaged with the gripper 60. Namely, as shown in FIG. 11, the gripper 60 is of a substantially C cross sectional shape having a pair of gripping pieces 61. The gripper 60 is made of a resilient material such as a spring steel or synthetic resin. Thus, the gripping pieces 61 releasably engage with the side walls of the operating handle 152 when the operating handle 152 is rotated to the operating position A as shown in FIG. 11.

Figure 14:
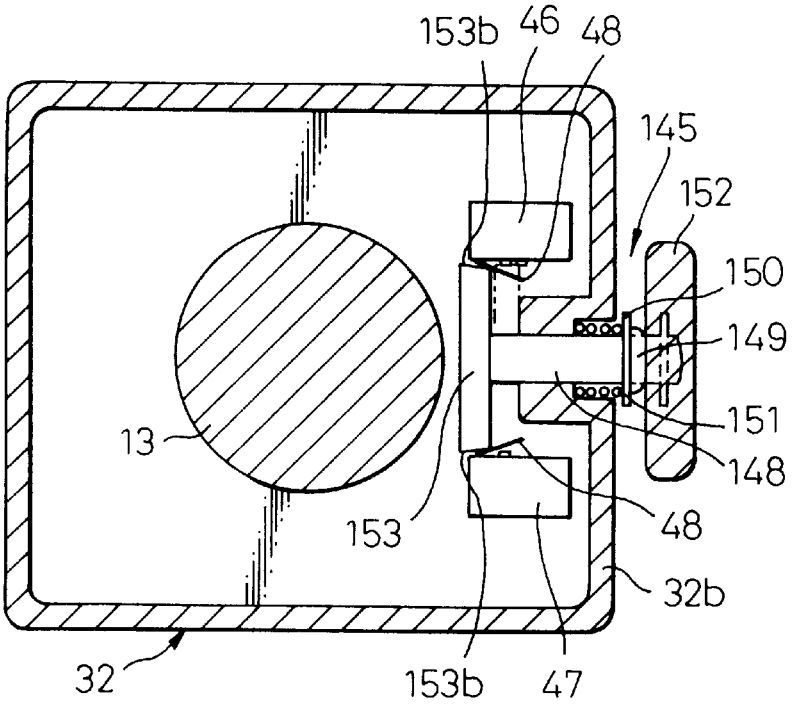
FIG. 14 is a sectional view taken along line XIV—XIV in FIG. 11.

At a location of the rear wall 32*b* of the cover 32, an operating member 145 is arranged. The operating member 145 functions as a switch holding/canceling means to maintain OFF positions of the stop/restart switches 46 and 47 when a braking operation by the brake shoes 134 is canceled and functions to cancel the OFF holding operation of the switches 46 and 47 when the brake operating member 1345 is returned to the rest position A. In more detail, the operating member 145 is, as shown in FIG. 14, provided with an operating shaft 148, which is slidably inserted to a hole in the rear wall 32*b* of the cover 32 in the front-to-back direction, while means is provided for preventing the operating shaft 148 from rotated about its own axis. The operating shaft 148 is projected rearwardly from the rear wall 32*b* of the cover 32 in such a manner that the projected end forms a head part 149, which is in contact with the front surface of the operating handle 152. Between the head part 149 and the rear wall 32*b* of the cover 32, a washer 150 and the spring 151 are arranged, so that the operating shaft 148 is urged to be moved in a rearward direction. The operating shaft 148 is formed with a front end projected to the space inside the cover 32 and an operating piece 153, which extends integrally and laterally from the shaft 148. The operating piece 153 forms, at the lateral ends, inclined end surfaces as cam control surfaces 153*b*.

Figure 15:
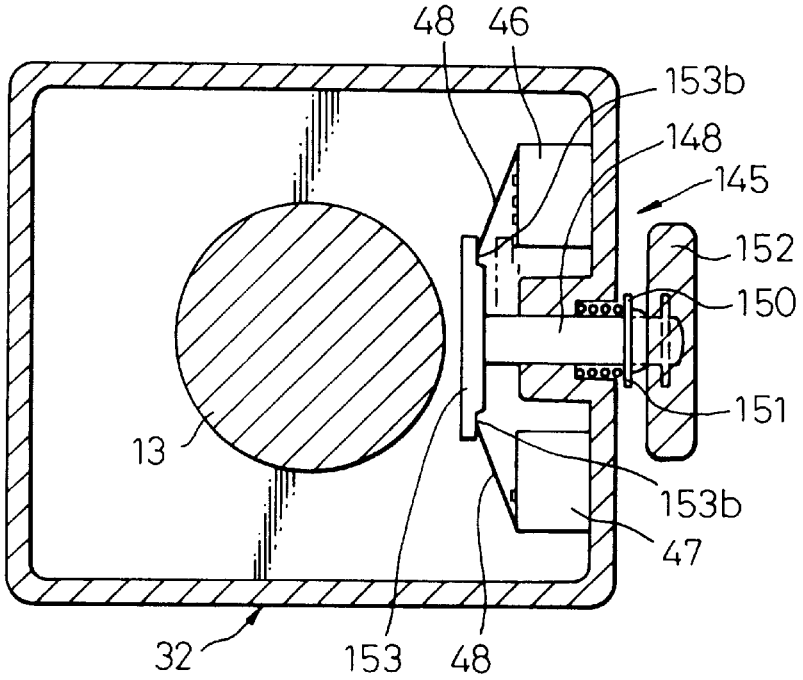
FIG. 15 is similar to FIG. 14 but is an illustration of another shape of an operating part.

On the cover 32 at locations laterally outward from the switch operating surfaces 153*b*, two stop/restart switches 46 and 47 are mounted, which have normally closed contacts located between the alternate current lines S and T and the drive motor 20. Furthermore, in the position A in FIG. 11 where the operating handle 152 is held by the holder member 60, the operating handle 152 pushes the head 149 of the operating shaft 148, so that the operating piece 153 is prevented from pushing the operating members 48 of the stop/restart switches 46 and 47, thereby maintaining the ON conditions of the switches. Contrary to this, when the operating handle 152 is released from the gripper 60 as shown by the dotted line B in FIG. 11, the force of the spring causes the operating shaft 148 to be moved rearwardly, so that the operating piece 153 pushes the operating members 48 inwardly, which causes the stop/restart switches 46 and 47 to be made OFF. It should be noted that the connection of the switches 46 and 47 with the alternate current lines R, S and T and the connection of the lines R, S and T with the inverter device and the alternate current source are identical as those shown in FIG. 4. Finally, as a modification, as shown in FIG. 15, a construction may also be possible in which a rear surface of the end of the operating piece 153 is formed as the switch operating surfaces 153*b*, to which the operating members 48 of the switches 46 and 47 face as shown in FIG. 15.

When an operator finds a yarn breakage, the operating handle 152 of the spindle 10 is disengaged from the gripping member 60 and is rotated from the rest position A to the brake operating position B. During the rotating movement, the operating shaft 148 is, under the spring force of the spring 151, retracted, so that the operating piece 153 comes to engagement with the operating members 48 of the stop/restart switches, causing the switches to be made OFF, thereby de-energizing the electric drive motor 20, which is, thus, brought into a condition that it rotates under its own momentum. Such a rotating movement of the spindle shaft 13 is stopped by a frictional resistance force which is generated when the shoes 134 at the ends of the brake operating member 135 are pressed against an upper surface of the flange portion 13*d*. When the operator removes his or her hand from the operating handle 152 after the stoppage of the spindle shaft 13, the brake operating member 135 is under a non-braking condition where the brake shoe 134 is not press contacted with the flange portion 13*d*. However, the position of the brake operating member 135 is not at the rest position A but at the non-braking position which is slightly spaced from the braking position B. Then, the end of the broken yarn is withdrawn in the similar way as explained with reference to the first embodiment, and, then, the operator pushes the operating member 135 to the rest position A, which causes the operating handle 152 to be pushed into the gripping member 60. This movement of the operating handle 152 causes the operating shaft 148 to be moved forwardly, so that the operating piece 153 is detached from the operating members 48 of the stop/restart switches 46 and 47, causing the switches to be made ON, which allows the drive motor 20 to be fed with the alternate current lines R, S and T, thereby causing the rotating speed of the spindle shaft 13 to instantly increase.

In the third embodiment, as explained above, the braking force is applied downwardly to the upper surface of the flange part 13*d* of the spindle shaft 13. Thus, the direction of the braking force is mainly along the axis of the spindle shaft 13. In other words, a component of the braking force in the direction transverse to the axis of the spindle shaft 13, which causes the later to be skewed, is small. Thus, an increased precision, which makes the laterally space braking parts 34 to be evenly and simultaneously applied to the flange part 13*d*, is not required, while preventing the spindle shaft 13 from being largely skewed during the braking operation, which otherwise causes the gap to be lost between the rotor 21 and the stator 22 and to make them to be brought into a mutual contact.

The above embodiments are directed to a spindle unit of a spindle-to-spindle driven type having a housing in which a mechanical braking device and stop/restart switches associated with the braking device. This arrangement is advantageous in that an installation of the spindle unit to the ring rail causes both of the braking device and the switches to be automatically installed. However, the present invention is not necessarily limited to the application to this integrated structure. For example, an arrangement is within the scope of the invention wherein a mechanical brake device as well as a stop/restart switch, which are separate from an independent driven spindle shaft, can be provided.

In the above description of the embodiments, the spindle shaft 13 is directed to the one having a damper for absorbing a vibration during a high speed rotating movement of the spindle. However, the present invention can be applied to a type of an independent driven spindle which is, as similar to a conventional alternate current electric motor, simply rotatably supported by vertically spaced bearing units between which a drive motor is arranged, i.e., a damper mechanism is not provided, as is disclosed, for example, in Japanese Unexamined Patent Publication No. 5-247738. In this construction, a braking force on one side of the axis of the spindle will not cause the gap to be changed between a rotor and a stator. However, this construction is also included in the scope of the present invention.

Figure 16:
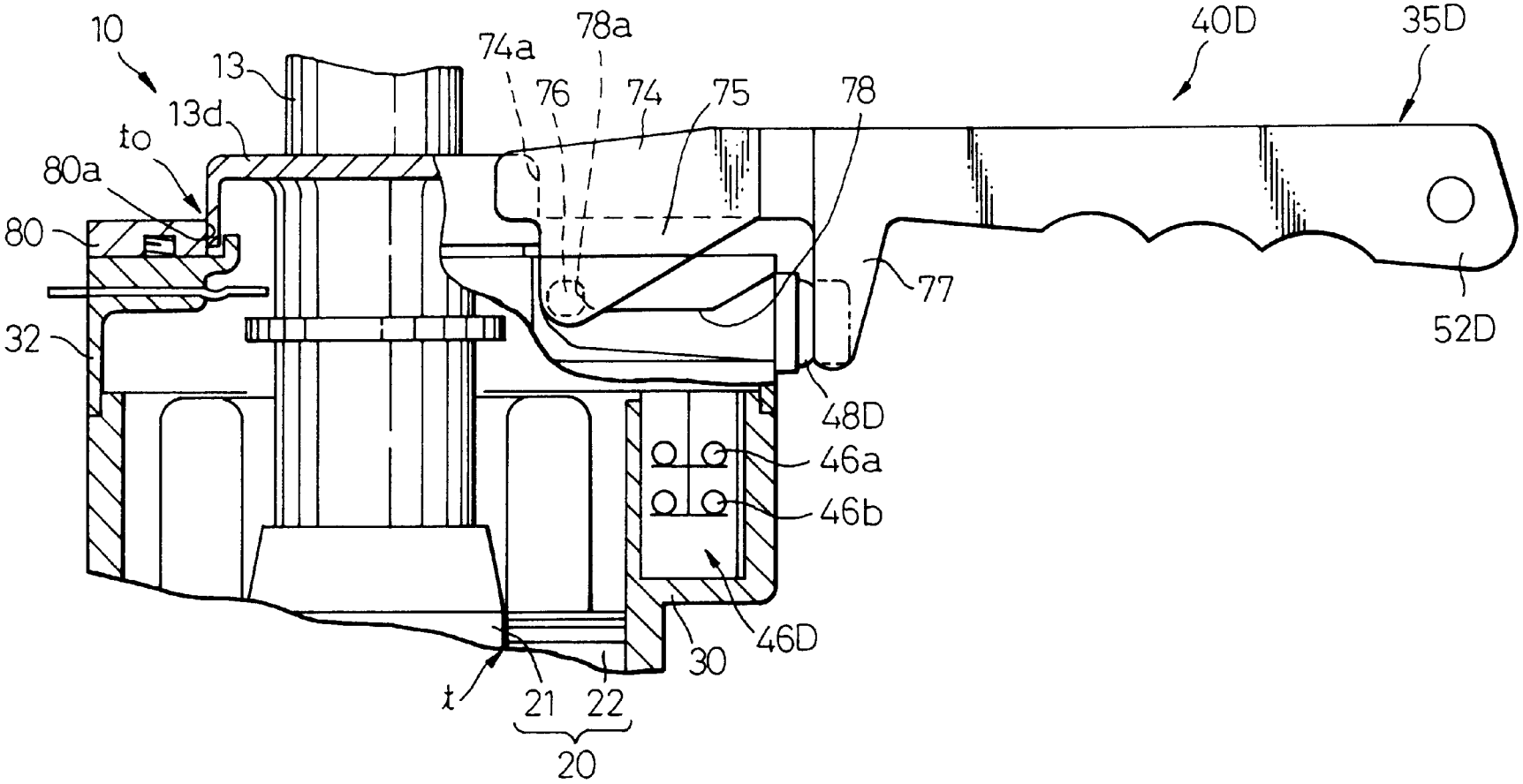
FIG. 16 is a sectional view illustrating a different embodiment of a braking device.
Figure 17:
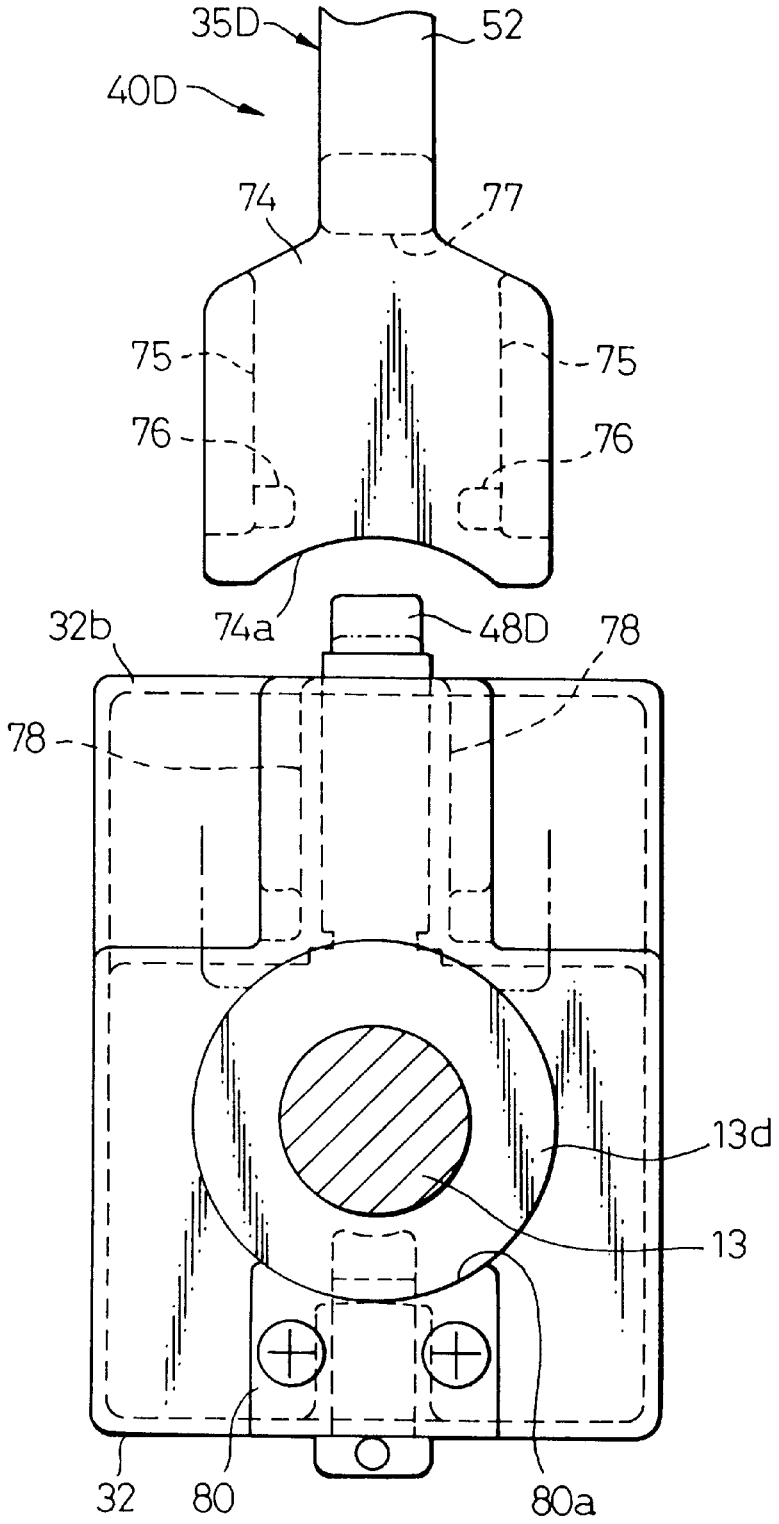
FIG. 17 is a plan view of FIG. 16.

FIGS. 16 and 17 illustrate a separate (fourth) embodiment wherein a braking device is structured by a portable type braking device 40D. A front portion of a brake-operating member 35D of the portable type braking device 40D is formed as a wider section 74 having a larger width than an operating handle 52D formed in a rear portion thereof. An arcuate braking surface (brake section) 74*a* to be in press contact with an outer circumference of a flange 13*d* is formed at a front end of the front portion 74. Bulge sections 75 project downward from opposite sides of a lower surface of the wider section 74, and engagement pins 76 projecting inward from the respective bulge sections 75 are integrally formed. Also, an actuator section 77 for operating a stop/restart switch 46D is integrally formed on a lower surface of a front portion of the operating handle 52D.

The stop/restart switch 46D is an alternate type ON/OFF switch accommodated in a housing 30 so that a switch button 48D projects rearward. Engagement grooves 78 for guiding the engagement pins 76 are provided on opposite side surfaces of the housing 30 closer to the switch button 48D. A front portion of the engagement groove 78 curves upward to form a hook-like profile. A stop 80 for stopping the spindle shaft 13 in association with the portable type braking device 40D is integrally formed on an upper surface of a front portion of a cover 32 of the housing 30. A surface of the stop 80 opposite to the outer circumference of the flange 13*d* is formed as an arcuate braking surface 80*a* complementary to the outer circumference of the flange 13*d*. A small gap $t_0$ is provided between the braking surface 80*a* and the outer circumference of the flange 13*d*. The small gap $t_0$, is selected to be smaller than a gap t between the rotor 21 and the stator 22 so that the contact of the rotor 21 with the stator 22 is prevented even when the brake-operating member 35D is applied to the spindle shaft 13 from a side on which the switch button 48D is present and the braking surface 74*a* of the brake-operating member 35D presses the outer circumference of the flange 13*d* to slightly tilt the spindle shaft 13 and to nip the outer circumference of the flange 13*d* in a diametrical direction between the braking surface 74*a* and the braking surface 80*a* of the stop 80.

When yarn breakage is detected, the operator pushingly applies the portable type braking device 40D to the spindle shaft 13 while engaging the engagement members 76*a* with the engagement grooves 78. During this pushing operation, the actuator section 77 pushes the switch button 48D to turn the stop/restart switch 46D OFF, which state is held to interrupt the power supply to the drive motor 20 whereby the spindle shaft 13 is subjected to inertial rotation.

Thereafter, the braking device 40D is further pushed forward to fit the engagement pin 76 into the hook-shaped section 78*a* of the engagement groove 78. When the operating handle 52D is raised while maintaining this state, the braking surface 74*a* presses the outer circumference of the flange 13*d* due to a lever action having a fulcrum at a contact point of the engagement pin 70 with the hook-shaped section 78*a*. Thus, the spindle shaft 13 is brought into press contact with the braking surface 80*a* while slightly tilting, whereby the spindle shaft 13 is nipped between the braking surfaces 74*a* and 80*a* and the braking load is applied thereto on both sides thereof in the diametrical direction to stop the spindle shaft 13. In a similar manner as in the third embodiment, while maintaining this state, the operator withdraws a broken yarn end to a position in front of the front rollers and releases the braking device 35D to turn the stop/restart switch 46A from OFF to ON. Thus, the drive motor 20 is supplied with a power source to rotate the spindle shaft 13. Then the yarn-piecing operation is carried out.

Figure 18:
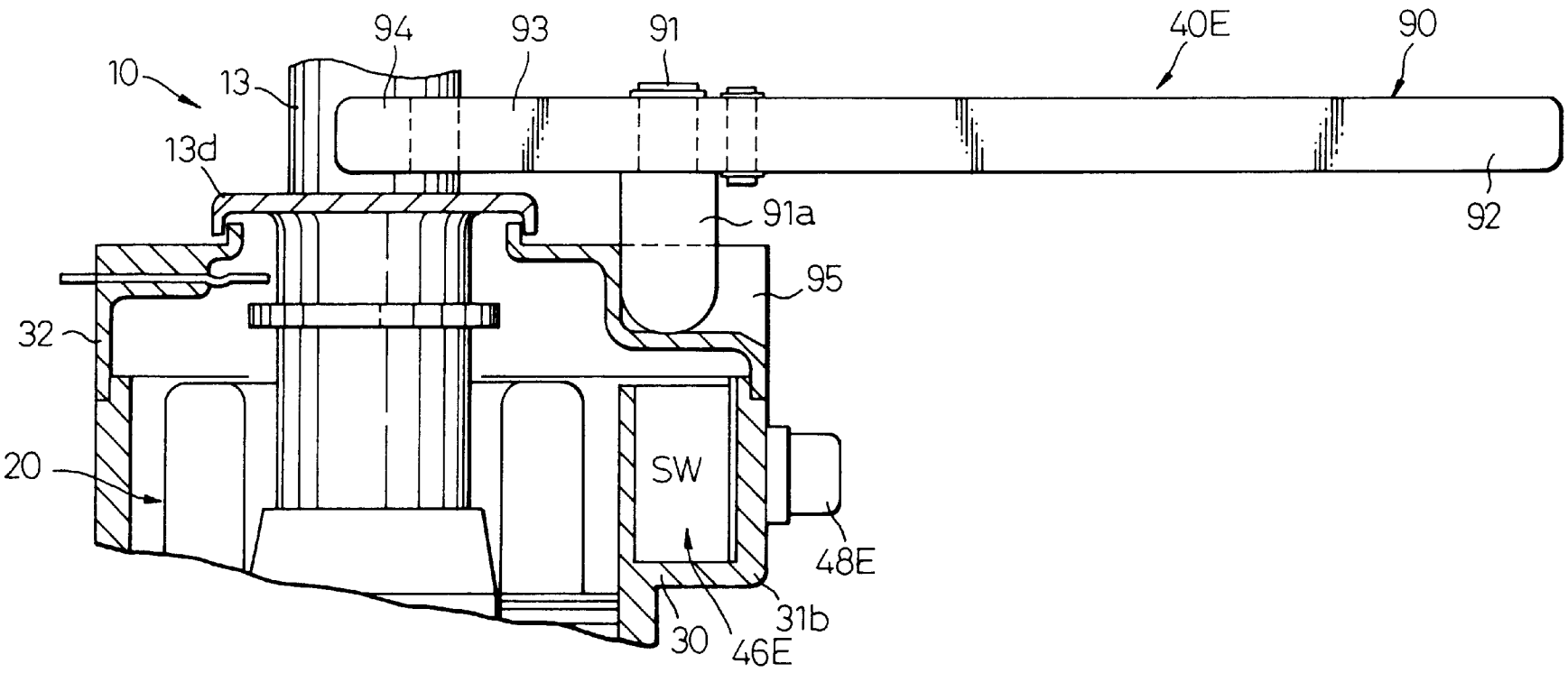
FIG. 18 is a sectional view illustrating a different embodiment of a braking device.
Figure 19:
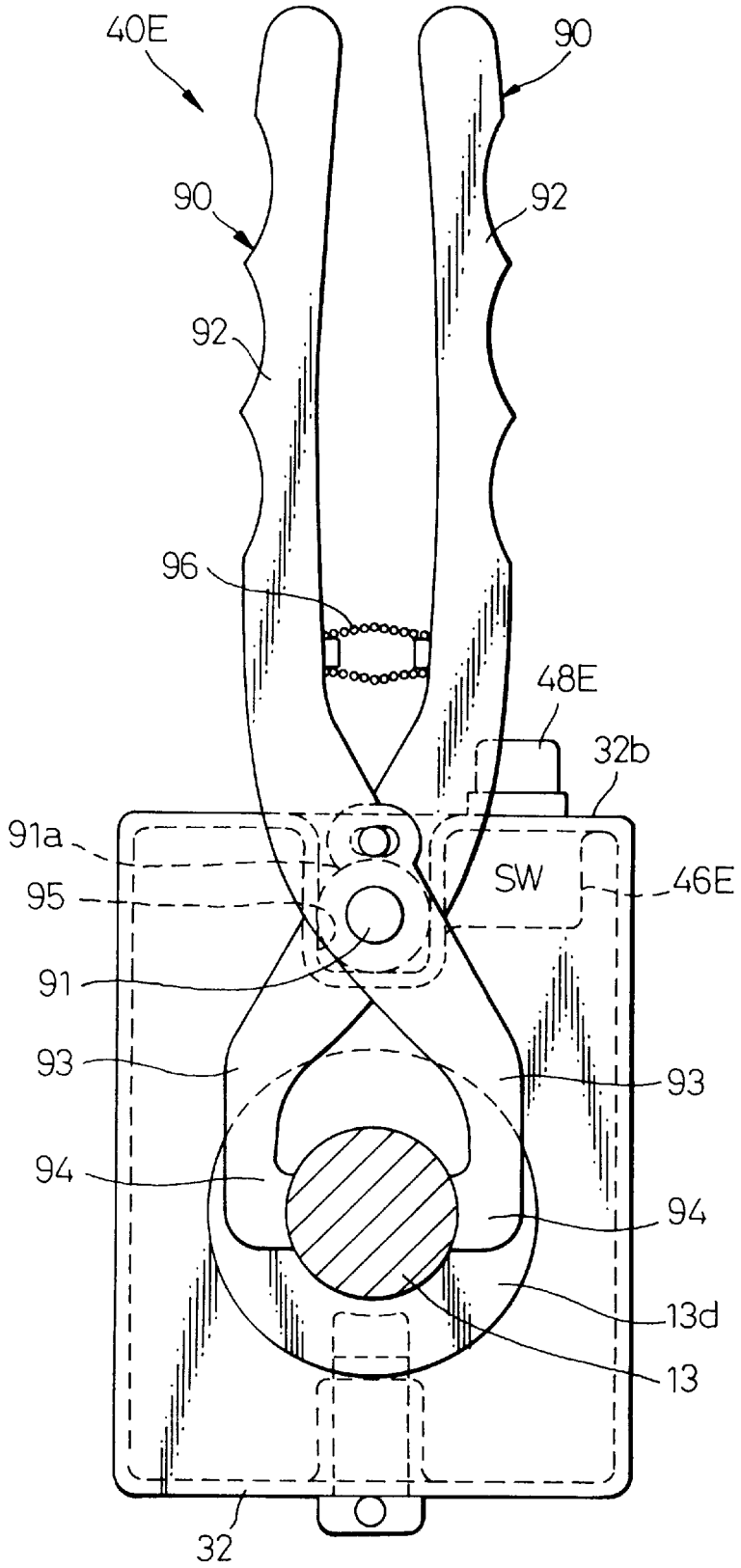
FIG. 19 is a plan view of FIG. 18.

Next, FIGS. 18 and 19 illustrate another (fifth) embodiment of a portable type braking device 40E. The portable type braking device 40E has a pair of brake-operating members 90 which are operative as a pincers relatively rotatable about a pin 91. Rear portions of the brake-operating members 90 form operating handles 92, and front portions thereof form grip sections 93. A free end of the grip section 93 bends inward to define brake sections 94. A spring 96 is interposed between the operating handles 92 to always bias both the operating handles 92 away from each other. The pin 91 projects downward from the brake-operating members 90 so that a projected portion forms an engagement section 91*a* engageable with an engagement groove 95 provided in a cover 32 of a housing 30. An external switch button 48E of a stop/restart switch (alternate switch) 46E is provided in a rear wall 31*b* of a main body of the housing 30 at a position closer to one side thereof.

When yarn breakage is detected, the operator pushes the switch button 48E to turn the stop/restart switch 46E from ON to OFF and hold this state. Thereby, the power supply to a drive motor 20 is interrupted, and a spindle shaft 13 is subjected to inertial rotation. Thereafter, the operator applies the engagement sections 91*a* of the portable type braking device 40E maintained so that the grip sections 93 are open due to the action of the spring 96 to the engagement grooves 95. Then, the operator grips the operating handles 90 so that the brake sections 94 simultaneously nips the spindle shaft 13 from both side in the diametrical direction, whereby the spindle shaft 13 is applied with a braking load and stops without tilting. Thereafter, the operator withdraws a broken yarn end to a position in front of the front rollers while the spindle shaft 13 is maintained stationary, releases the braking device 40E, turns the stop/restart switch 46E from OFF to ON to supply the drive motor 20 with power so that the spindle shaft 13 is restarted, and carries out the yarn piecing operation.

Figure 20:
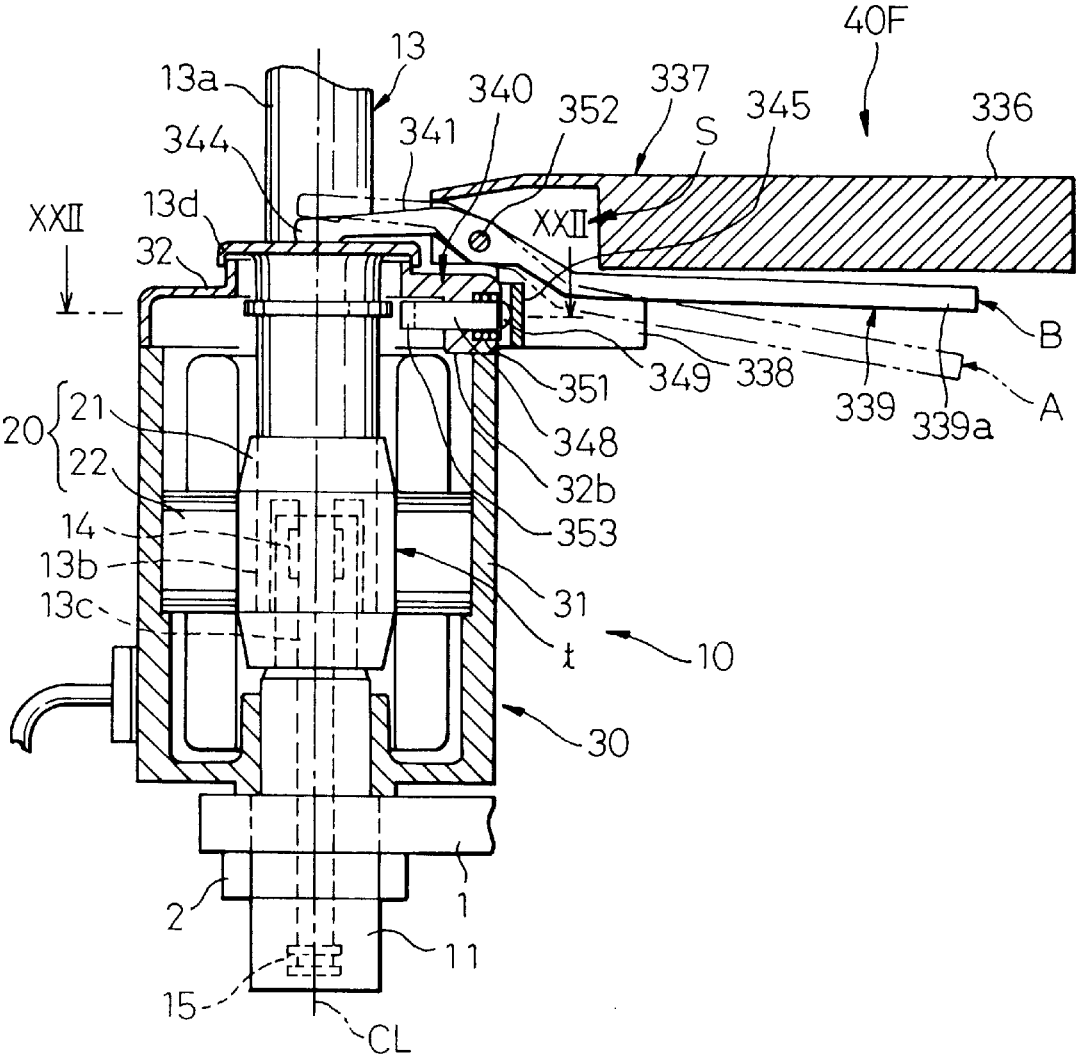
FIG. 20 is a side sectional view of a single drive spindle of a different embodiment.

FIGS. 20 to 23 show another (sixth) embodiment of portable type braking device 40F. In FIG. 20, a transmission device 340 is arranged in the cover 32 of the housing 30 in such a manner that a movement of the portable type braking device 40F is transmitted to the switches 46 and 47. The transmission device 340 includes an operating shaft 348 which is slidable with respect to a rear wall 32*b* of the cover 32 while it is prevented from being rotated about its own axis. The operating shaft 348 is projected out of the rear wall 32*b* and forms a head portion 349, which is engaged with an operating part of the device 40F. Between a washer 350 on the shaft 348 and the rear wall 32*b* of the cover 32, a spring 351 is arranged for urging the shaft 348 in a rearward direction. An operating piece 353 is integrally connected to an inner end of the shaft 348 and is formed with beveled switch operating surfaces 353*b*, which, in a similar way, as explained with the embodiment in FIG. 14, cooperate with the respective switch operating members 48 of the switches 46 and 47, respectively. Namely, in a normal condition the operating shaft 348 is located in the outwardly projected position under the effect of the force of the spring 351 and the switches 46 and 47 are normally ON. After an inward movement of the shaft 348 against the force of the spring 351 due to the fact the portable braking device 40F is mounted to the spindle, the operating piece 353 causes the switch operating members 348 to be pushed, which causes the switches 47 and 48 to be switched OFF. The cover 32 is formed with, at the rear wall 32*b* of the cover, a pair of mounting holes 355 which allow the portable braking device 40F to be positively held by the spindle.

Figure 21:
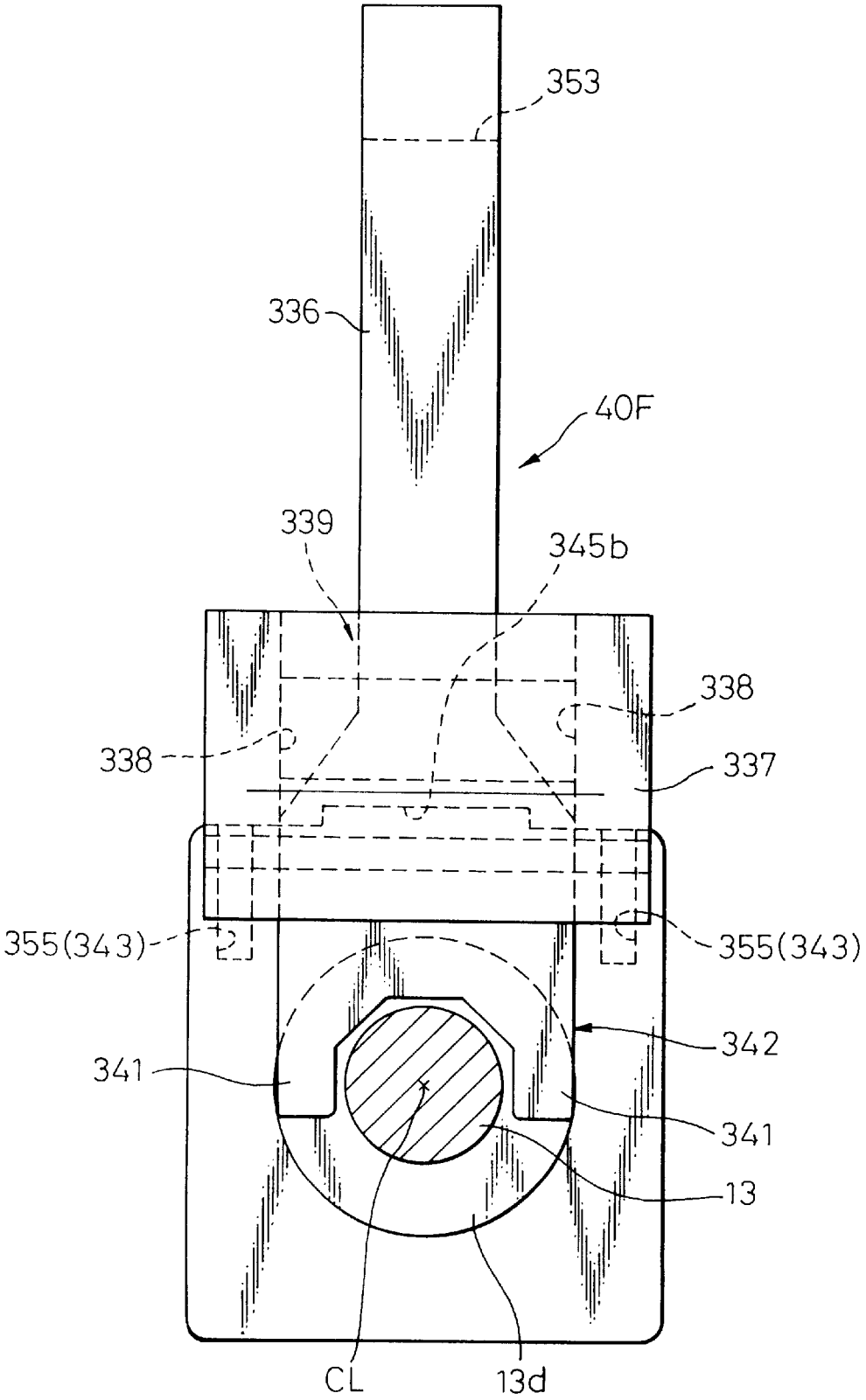
FIG. 21 is a top plan view of the single drive spindle in FIG. 20.
Figure 22:
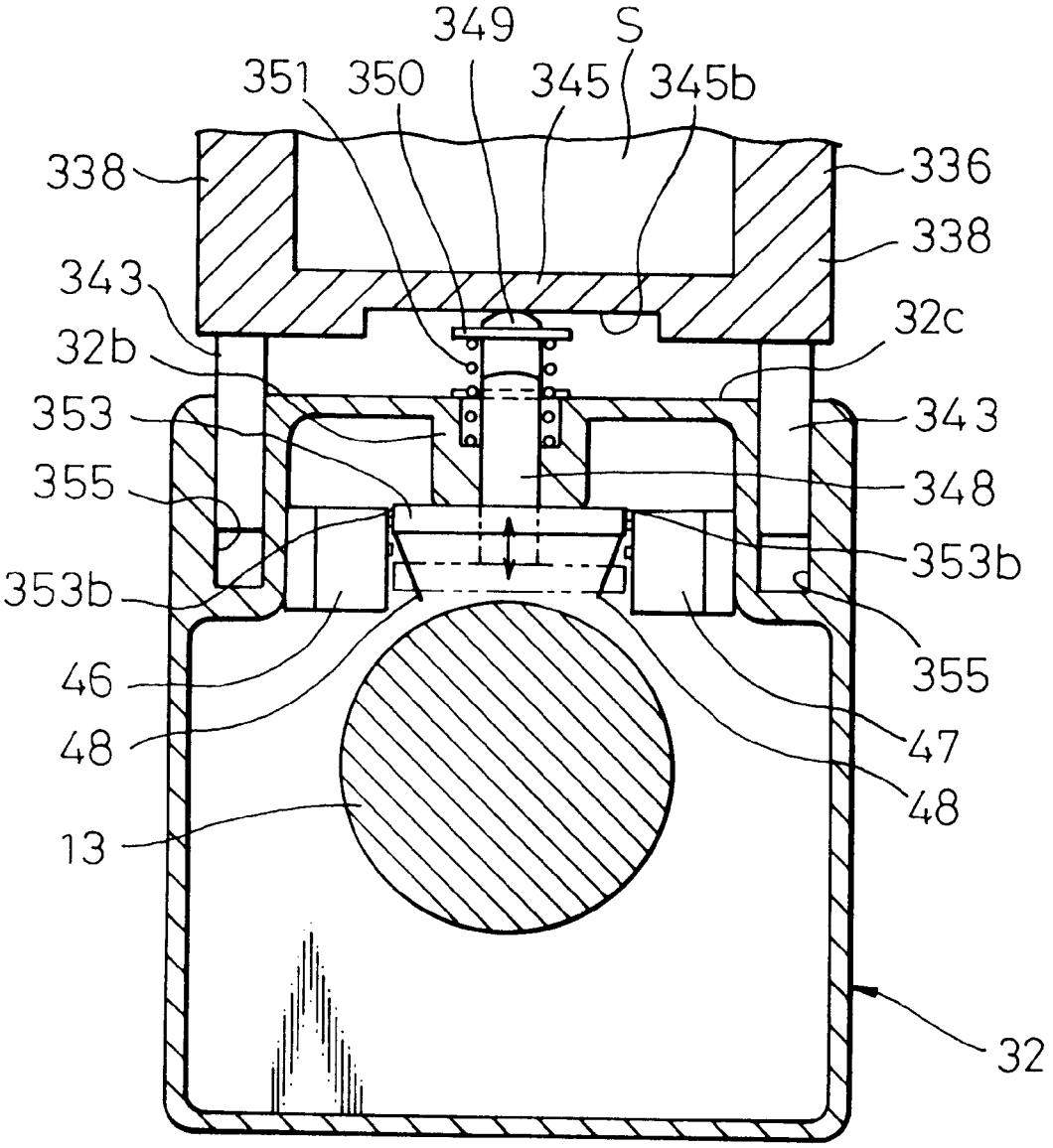
FIG. 22 is a cross-sectional view taken along a line XXII—XXII in FIG. 20.
Figure 23:
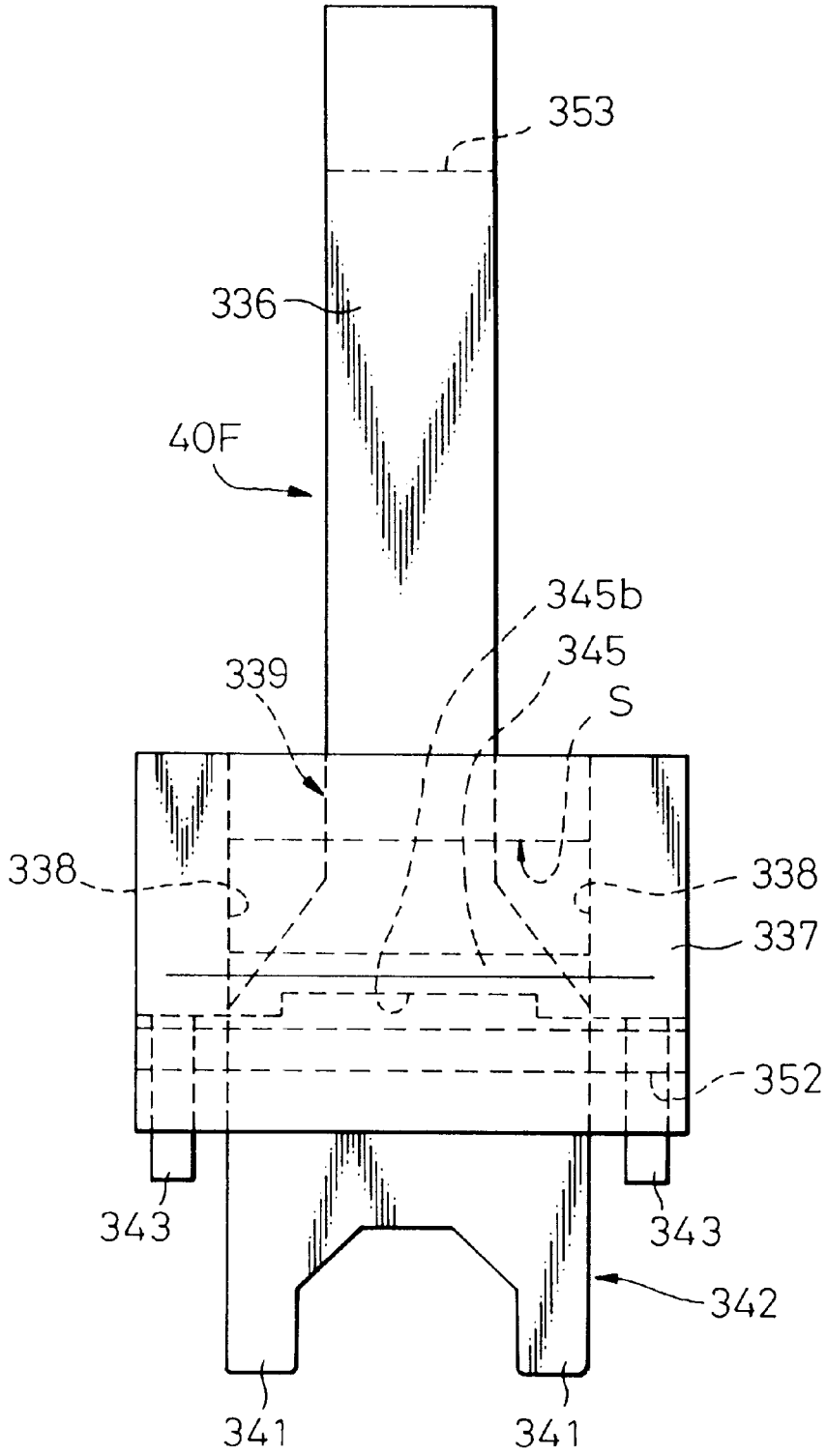
FIG. 23 is a top plan view of a portable braking device in FIG. 20.

As shown in FIGS. 21 and 23, the portable type braking device 40F is provided with an operating handle 336, which has a widened front portion 337 which has a pair of downwardly depended side walls 338 between which a space S for holding therein a brake operating member 339 is formed. Namely, the brake operating member 339 has an intermediate portion, which is located between the side walls 338 and supported thereto by means of a shaft 352, so that the brake operating member 339 can be rotated vertically. The brake operating member 339 has a rear end which is formed as a grip portion 353. The brake operating member 339 forms, at its front end, a bifurcated portion 342 which has a pair of arms 341 between which the spindle shaft 13 is located under the operated condition of the portable braking device 40F. A weight distribution of the brake operating member 39 about the axis of the shaft 352 is such that the weight of a part on the side of the grip portion 340 is larger than a weight of a part on the side of the bifurcated portion 342. The operating handle 337 has a front wall 345 which extends horizontally between the side walls 338 at a position slightly rearward and lower than the shaft 352. The front wall 345 functions as an operating portion, which, in a properly mounted condition of the device 40F to the spindle, causes the operating shaft 348 to be pushed inwardly, so that switching of the switches 46 and 47 occurs. Extending integrally from the front wall 45 are a pair of mounting rods 343, which are inserted into respective mounting holes 355 of the spindle cover 32 when the portable braking device 40F is mounted to the spindle by an operator in order to execute a yarn ending operation. Under such a mounted condition of the portable braking device 40F, the brake operating member 339 is moved between a waiting position A as shown by a phantom line and a brake operating position B as shown by a solid line. Finally, the arms 341 of the bifurcated portion 342 have, at the front end portions, brake shoe portions 344 which cooperate with the flange portion 13*d* of the spindle 1 for executing a braking operation of the spindle.

In the operation of this embodiment, when a yarn breakage on a spindle 1 is found by an operator who patrols the spinning machines, the operator takes out the device 40F and mounts it to the spindle by inserting the mounting shafts 343 into corresponding mounting holes 355 in the cover 32 of the spindle. During the process of pushing the device 40F until the front wall 345 is contacted with the rear surface 32*c* of the rear wall 32*b* of the cover 32, the recessed part 345*b* engages the operating shaft 348 and pushes the latter against the force of the spring 351, in the direction toward the spindle shaft 13, so that the operating piece 353 causes the operating members 48 to be pushed, which causes the switches 46 and 47 to be made OFF, thereby de-energizing the electric motor 20, resulting in the motor 20 to continue rotating under its own momentum. In this condition where the braking device 40F is merely inserted to the spindle, the handle 339 is in the waiting position A where the arms 341 of the bifurcated portion 342 on the sides of the spindle shaft 13 are spaced from the flange part 13*d* due to the fact that the weight of the handle 339 is heavier than the bifurcated portion 342.

Then, the operator grasps the stationary handle 336 and the movable grip 353, so that the operating member 339 is moved to the operating position B, which causes the brake shoes 334 to be pressed to the braking flange 13*d*, thereby generating a frictional force, which causes the spindle shaft 13 to be stopped.

After the completion of the stoppage of the spindle, the operator release the grasp of the grip 353, which causes the brake operating member 339 to be returned to the waiting position A. Then, a broken end of the yarn is taken out from the bobbin on the spindle, is passed through a traveler and a snail wire, and is held at a location in front of a front drafting roller, while the operator detaches the portable braking device 40E from the spindle in such a manner that the mounting rods 343 are withdrawn from the respective mounting holes 355. During the withdrawal of the brake device 40F, the operating shaft 348 is moved rearwardly by the action of the spring 351, which causes the operating piece 353 to be moved outwardly, which causes the switches 47 and 48 to be switched from the OFF position to the ON position. Thus, the AC motor 20 is again fed with power. Then, an ending process of the broken yarn is executed in the similar way as explained with reference, in particular, to the first embodiment.

Figure 24:
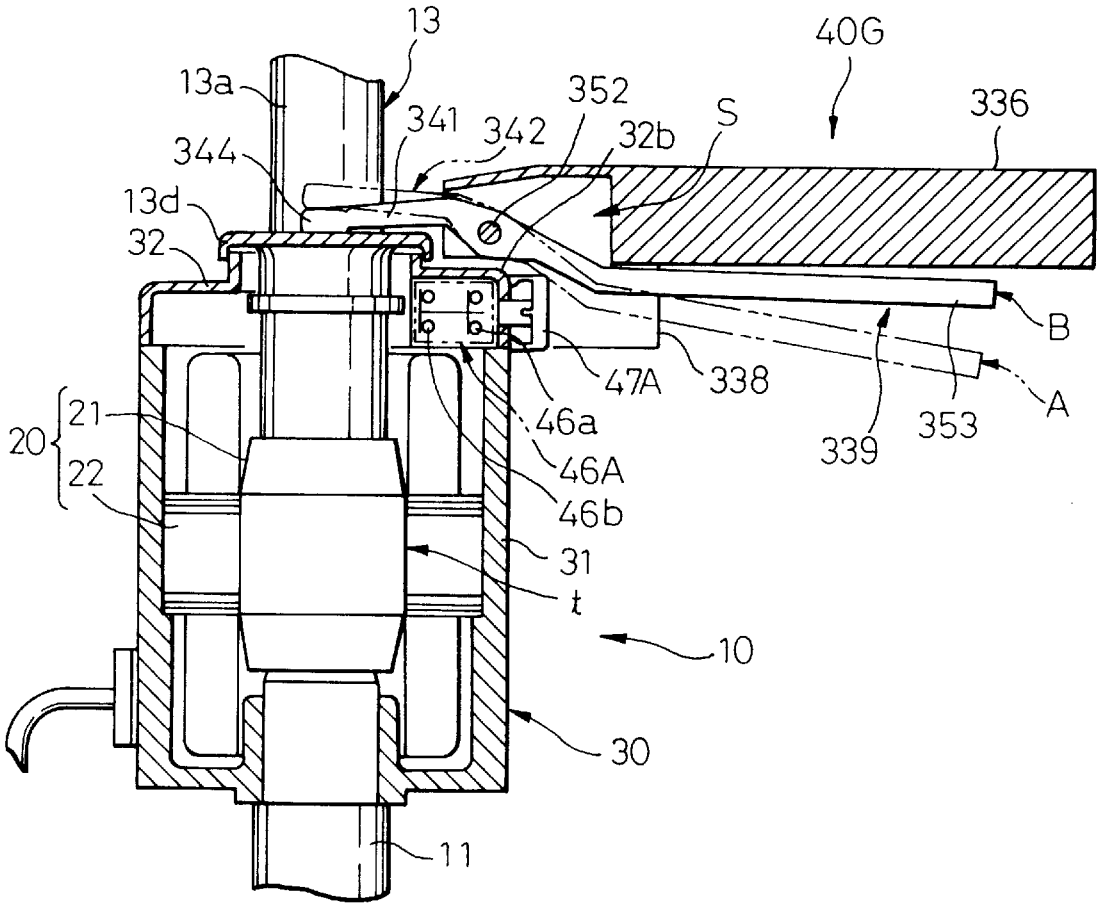
FIG. 24 is a side sectional view of a single drive spindle in another embodiment.
Figure 25:
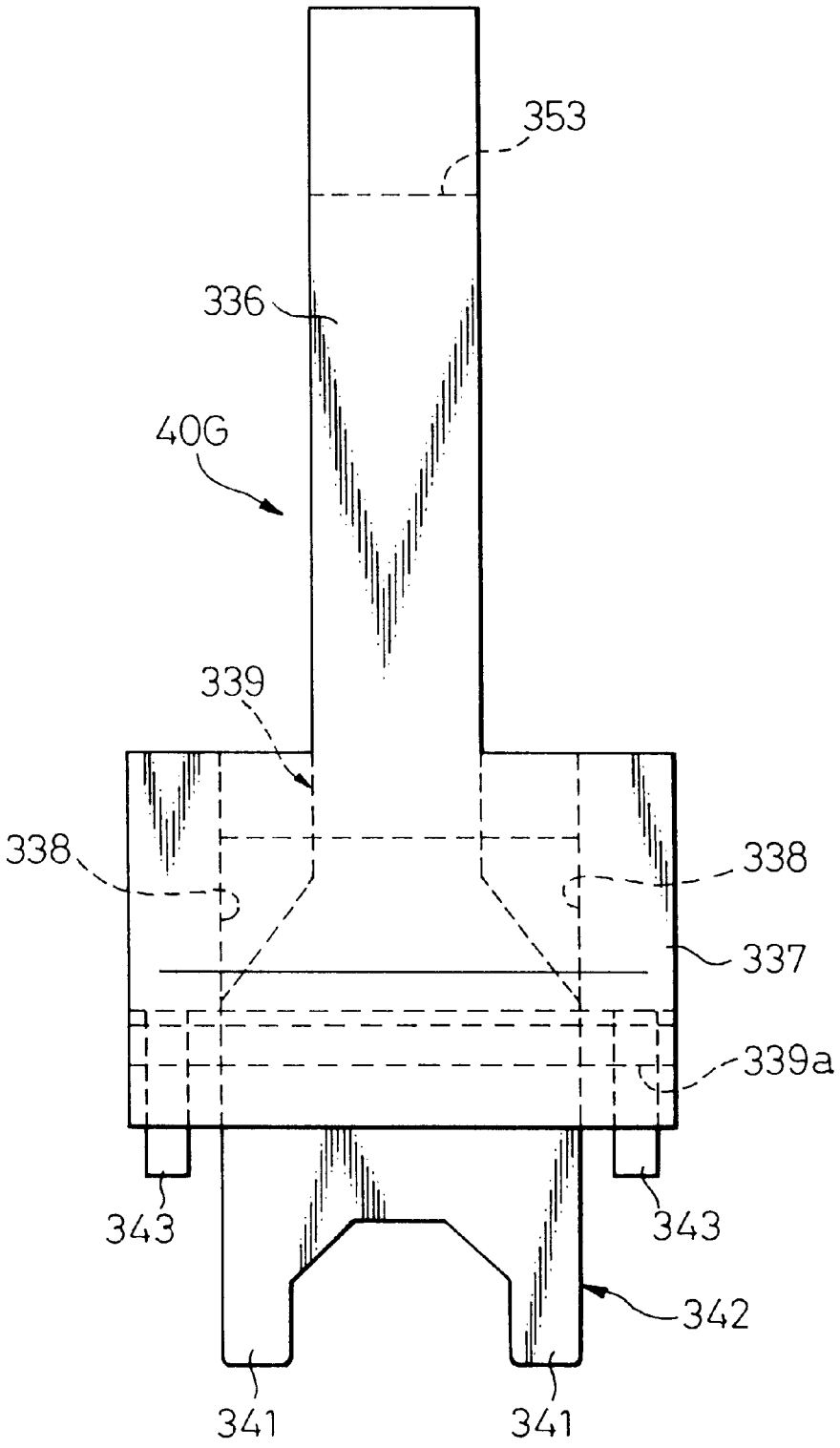
FIG. 25 is a top plan view of a portable braking device in FIG. 24.

A (seventh) embodiment shown in FIGS. 24 and 25 is a portable braking device 40G in a modification of the embodiment in FIGS. 20 to 23, which features that it is not provided with a device for mounting a portable braking device to a spindle to cooperate with an ON or OFF operation. Namely, in this embodiment, parts which correspond to the parts 348 to 353*b* in the embodiment in FIGS. 24 and 25 are eliminated. Thus, in place of the two operating switches 46 and 47, only a single switch 46A is provided. The switch 46A is of a so-called alternate type which is provided with a pair of normally closed contacts 46*a* and 46*b*, which are operated in unison. Namely, the switch 46A is provided with a push button 47A, which is projected outwardly from a rear wall of a cover 32*b* and which, once manually operated (pushed) by an operator, causes conditions of the switches 46A to be changed to different conditions, i.e., to be switched from ON conditions to OFF condition vise versa, which are maintained so long as the push button 47A is maintained non-operated. The stop/restart switch 46 may be another type of switch such as a toggle switch.

The construction of the portable braking device 40G in this embodiment is identical to that in the last embodiment in FIGS. 20 to 23 except that the front wall 345 for causing the operating shaft 348 to be pushed in the last embodiment is eliminated. Thus, a further explanation will be omitted.

In an operation of this embodiment, when a broken yarn is found by an operator, the operator will operate the switch 46A so that the latter is switched from the ON position to the OFF position, which causes the drive motor 20 to be disconnected from the AC power source, so that the drive motor 20 rotates under the effect of its own momentum. The operator, then, attaches the portable braking device 40G by inserting the mounting shaft 343 into the mounting holes 355. Then, similarly to the preceding embodiment, the operator grasps the grips 336 and 353, so that brake operating member 339 is moved, from the rest position A to the operating position B, so that the brake shoes 344 are contacted with the flange portion 13*d* of the spindle shaft 13, thereby braking the spindle 1. Then, the operator picks up the broken end of the yarn and held it at a location in front of the front drafting roller of the fine spinning frame, while the operator removes the device 40G from the spindle. Then, the operator pushes the alternate switch 40A, so that its contact is moved from OFF condition to ON condition, which allows the electric motor 20 to be fed with power, thereby causing the latter to be energized. Then, a piecing of the yarn is executed.

Figure 26:
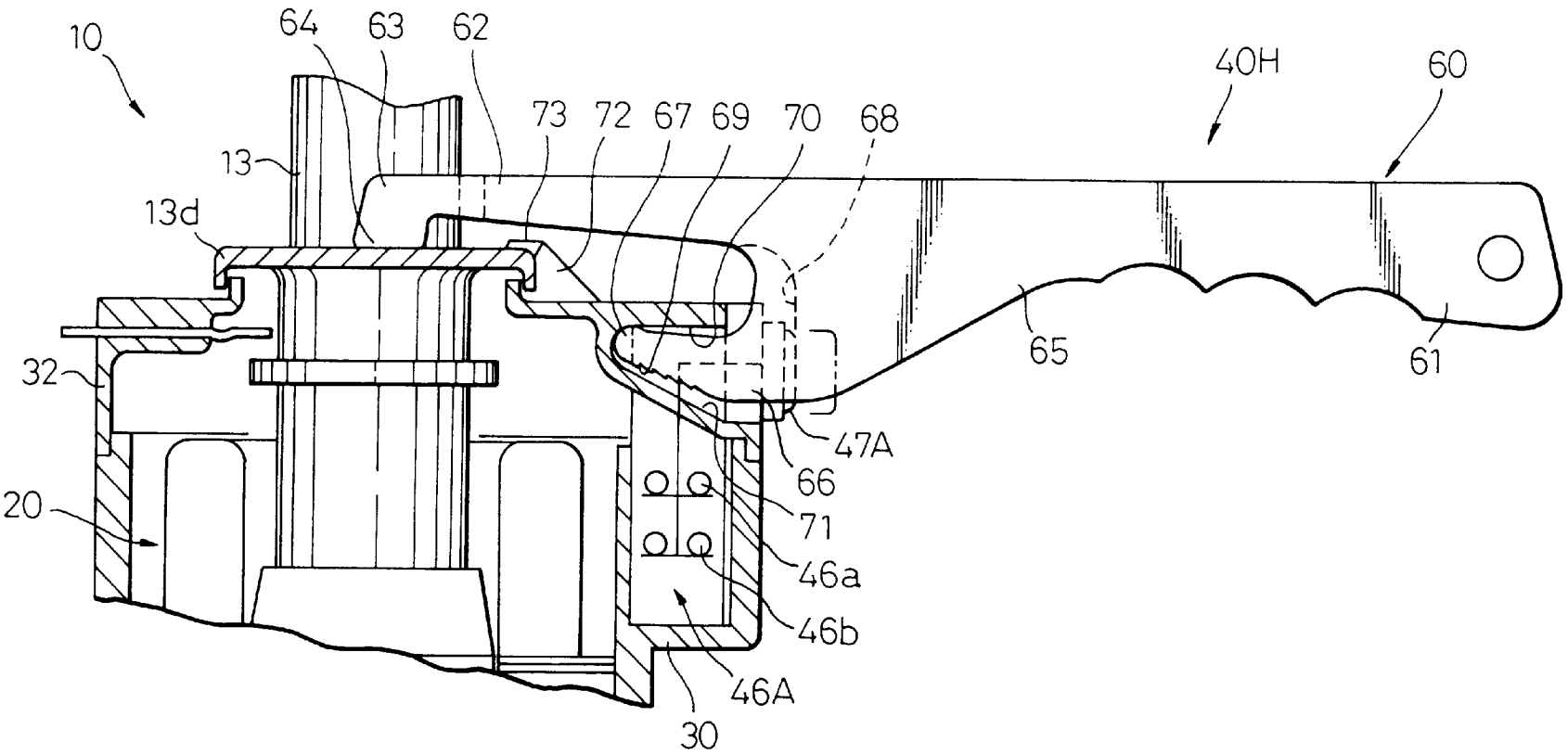
FIG. 26 is a side sectional view of a single drive spindle in another embodiment.
Figure 27:
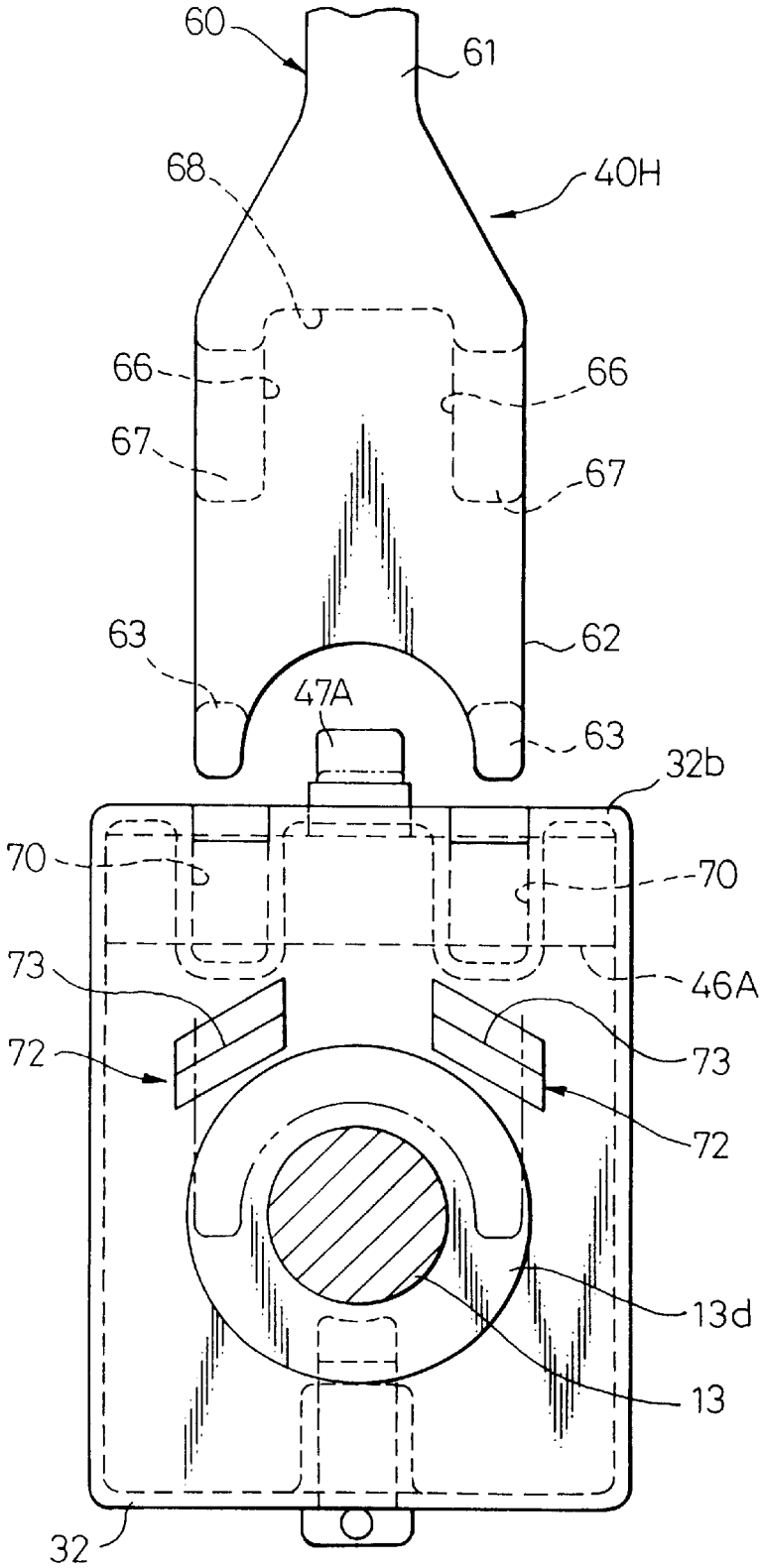
FIG. 27 is a top plan view of the single drive spindle in FIG. 26.

In an (eighth) embodiment, as shown in FIGS. 26 and 27, a portable braking device 40H includes brake operating member 60 having a handle part 61 and a bifurcated portion 62 of a width larger than that of the handle part 61. The bifurcated portion 62 includes a pair of arms which form, at their lower parts, brake shoes 64. The brake operating member 60 has, at its intermediate portion, a downwardly extended (bulged) portion 65, from which a pair of engaging parts 66, which are spaced along the width of the member 60, are integrally and horizontally extended. The engaging parts 66 are slightly bent upwardly so that their free ends form engaging parts 67. Finally, the brake operating member 60 forms, at a location between root portions of the catching parts, a wall 68 which functions as an operating part of the stop/restart switch 46A. Finally, the left-handed and right-handed engaging parts 66 form, at their bottom surfaces, serrated catching parts 69.

The stop/restart switch 46A is, similarly to the preceding embodiment, constructed as an alternate type ON/OFF switch having a pair of contacts 46*a* and 46*b*. The stop/restart switch 46A is arranged inside the housing 30, so that a switch button 47A extends rearwardly. On the sides of the switch button 47A, the spindle cover 32 of the housing 30 is formed with a pair of engaging holes 70 having bottom surfaces inclined downwardly. Furthermore, the cover 32 is formed with projections 72 which are spaced in the direction of the width at locations substantially corresponding to those of the engaging holes 70. The projections 72 have top portions 73 which are located above the upper surface of the flange 13*d* of the spindle shaft 13. When the latter is inserted, from the side of the switch button, to the spindle for executing a braking operation, the top portions 73 of the projections 72 contact the forward end of the brake operating member 60 so as to guide the latter, which prevents the brake shoes 64 from being laterally contacted with the flange 13*d*, thereby preventing the spindle from being damaged.

During the operation of this embodiment, the operator who has found a yarn breakage holds a portable braking device 40H so that the engaging members 66 are fitted with the engaging holes 70 in the housing 30. During the fitting, the braking parts 64 of the braking device 40H are subjected to a guiding action by the top parts 73 of the guiding projections 72, which prevents the braking parts 64 from being laterally engaged with the flange 13*d* of the spindle shaft 13 which is still rotating, so that the brake shoes 64 can be brought to positions axially above the flange 13*d*. Prior to that, the engaging members 66 are pushed into the deepest positions in the engaging holes 70, the engaging wall 68 contacts with the switch button 47A, which is pushed, so that the stop/restart switch is switched from the ON position of OFF position, which causes the electric drive motor 20 to be de-energized, so that a rotating movement continues under the effect of momentum.

Then, the operator displaces the handle 61 upwardly, so that the handle 61 is subjected to the rotating movement about a fulcrum as a point of a contact of the end of the engaging member 66 and the engaging hole 70, so that the braking portions 64 contact the upper surface of the flange 13*d*, thereby generating a braking force, resulting in a stoppage of the spindle 13. In this stopped condition, the end of the broken yarn is taken out to a position in front of the front roller, which is followed by removal of the portable braking device 40H. Such a movement of the braking device for the removal assists in that flies in the engaging holes are dug out. The stop/restart switch 46A, which is still in the OFF condition, is now pushed, so that the switch 46A is switched from the OFF condition to the ON condition, which allows the electric drive motor 20 to be energized, so that a quick increase in the rotating speed of the spindle shaft occurs. Then, a piecing operation of the broken yarn is executed.

In the eighth embodiment, in place of the alternate type switch, another type of a switch is employed, wherein switching from the OFF condition to the ON condition for allowing the electric drive motor to be energized occurs when the portable braking device 40H is removed from the spindle device 10.

Figure 28:
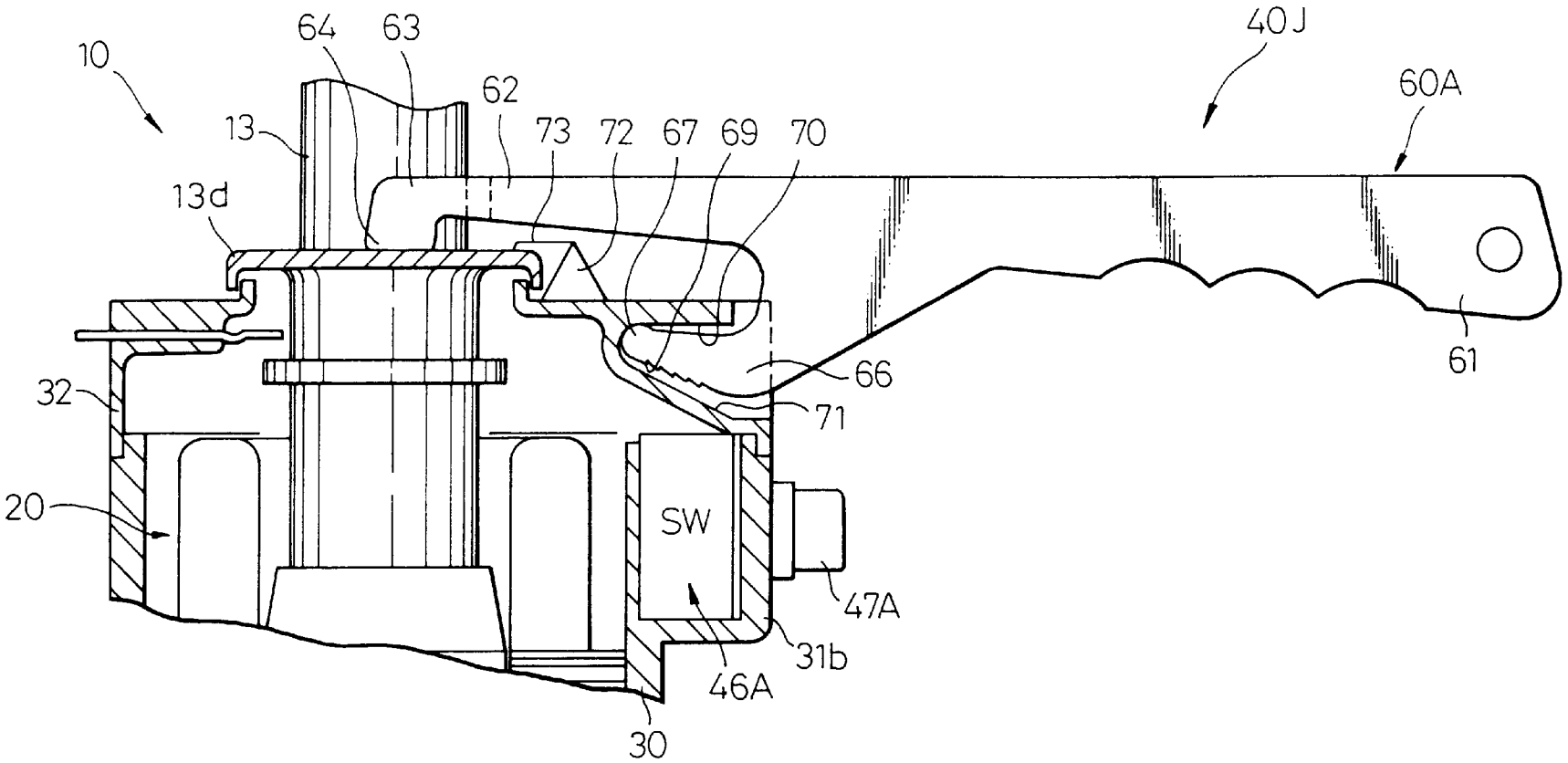
FIG. 28 is a side sectional view of a single drive spindle in another embodiment.
Figure 29:
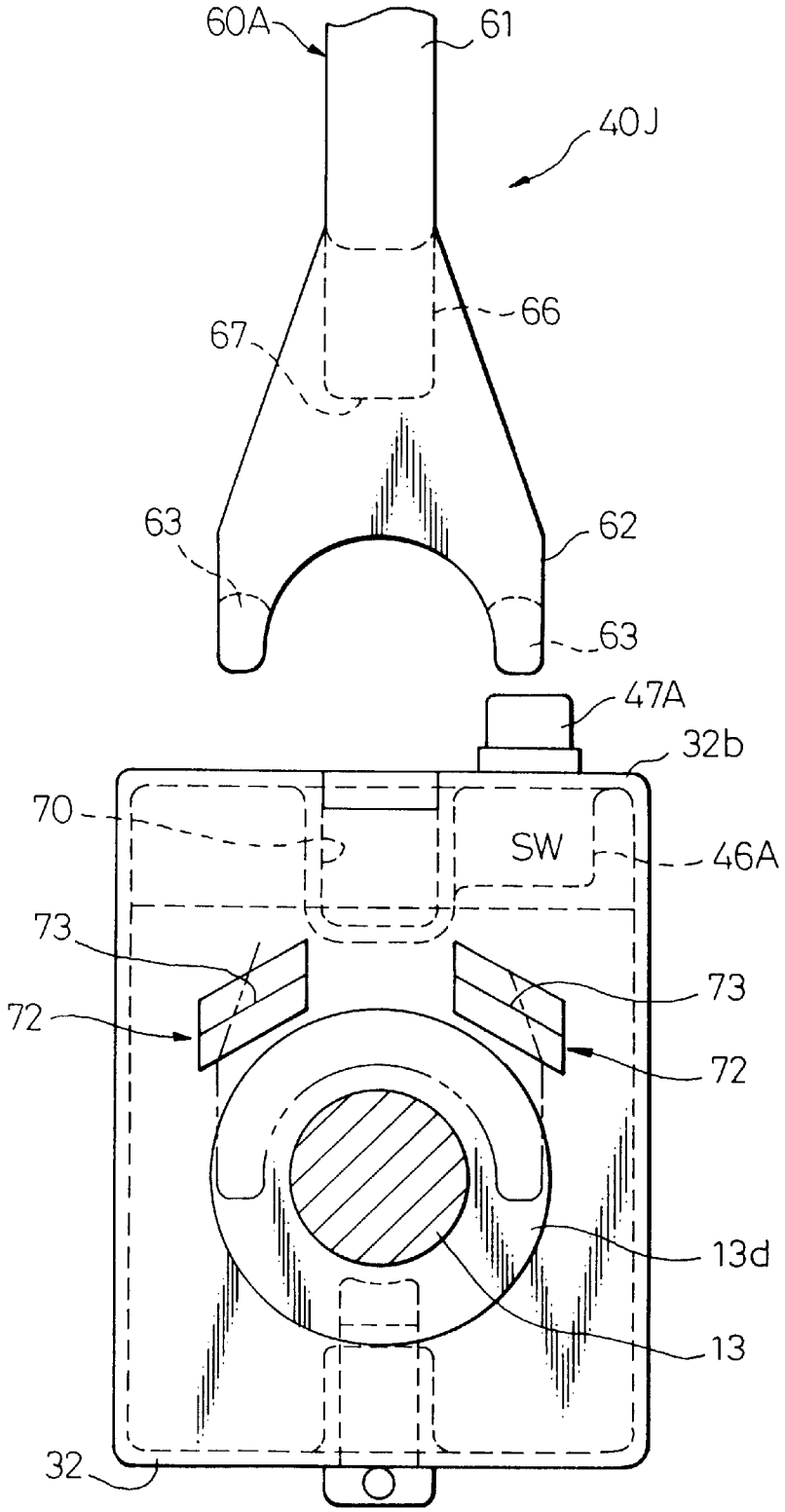
FIG. 29 is a top plan view of the single drive spindle in FIG. 28.

In the eighth embodiment, a laterally spaced pair of engaging members 66 are provided so as to create, between the members 66, the switch operating part for causing the stop/restart switch 46A to be operated, thereby causing the electric motor to be disconnected from the AC source. In comparison to this, in a (ninth) embodiment in FIGS. 28 and 29, a portable braking device 35C includes only one engaging member 66 at a central location in the direction of the width at a vertically lower side. Thus, no switch operating part is provided and only one engaging hole 70 is formed in the housing 30 of the drive motor 20. Furthermore, a stop/restart switch (alternate switch) includes an external switch button 47A on a rear wall 31*b* of the body of the housing 30 at a location which is offset in a lateral direction. Thus, the stop/restart switch is not linked with the attachment or removal of the portable braking device 40J. The remaining construction is the same with reference to the preceding embodiment.

The eighth and ninth embodiments are advantageous in that the brake operating members 60 and 60A are integrated with the braking devices 40H and 40J, thereby reducing the number of the parts, thereby reducing a production cost, while reducing a weight, which is suitable for a portable use.

Figure 30:
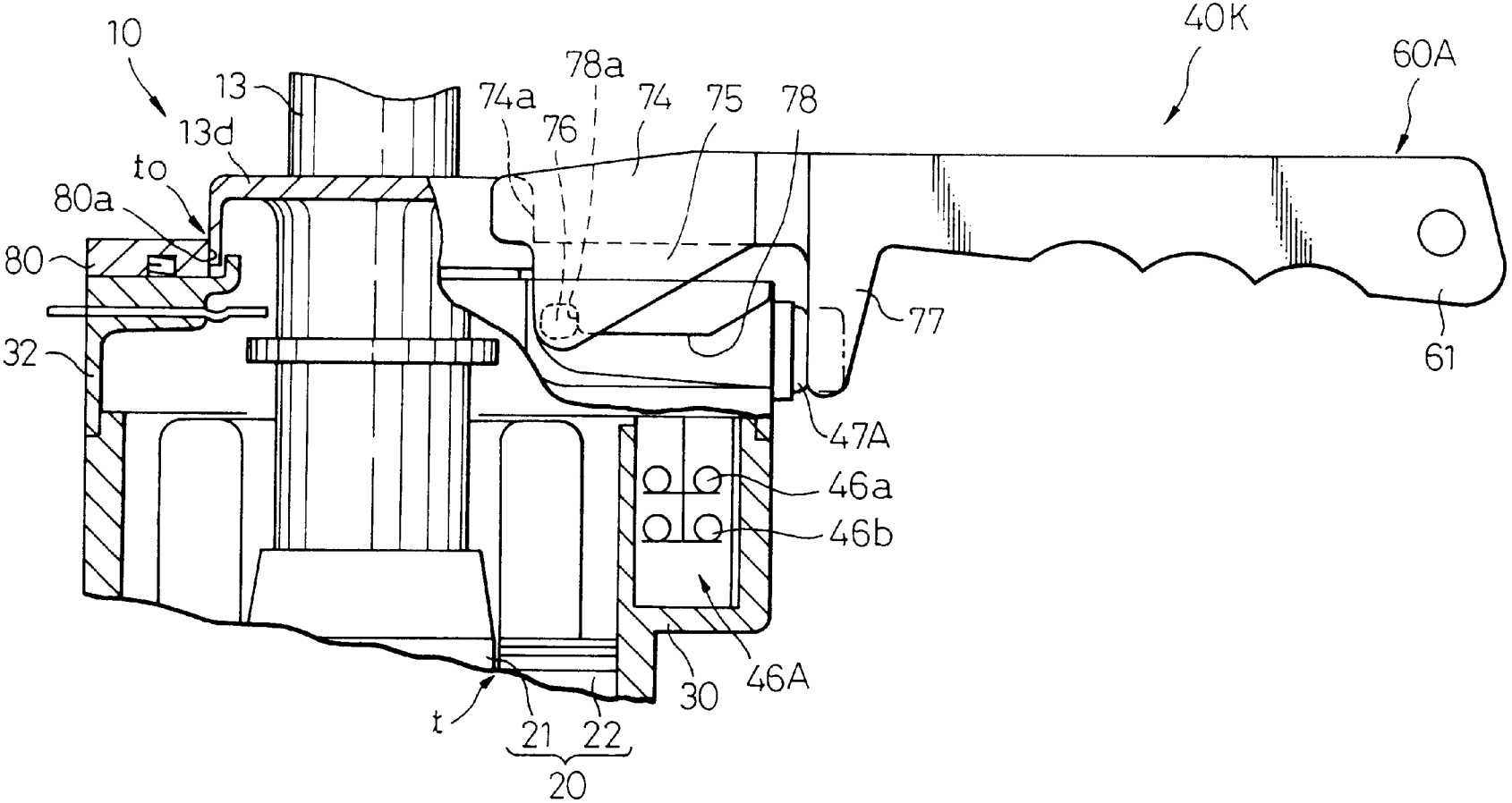
FIG. 30 is a side sectional view of a single drive spindle in another embodiment.
Figure 31:
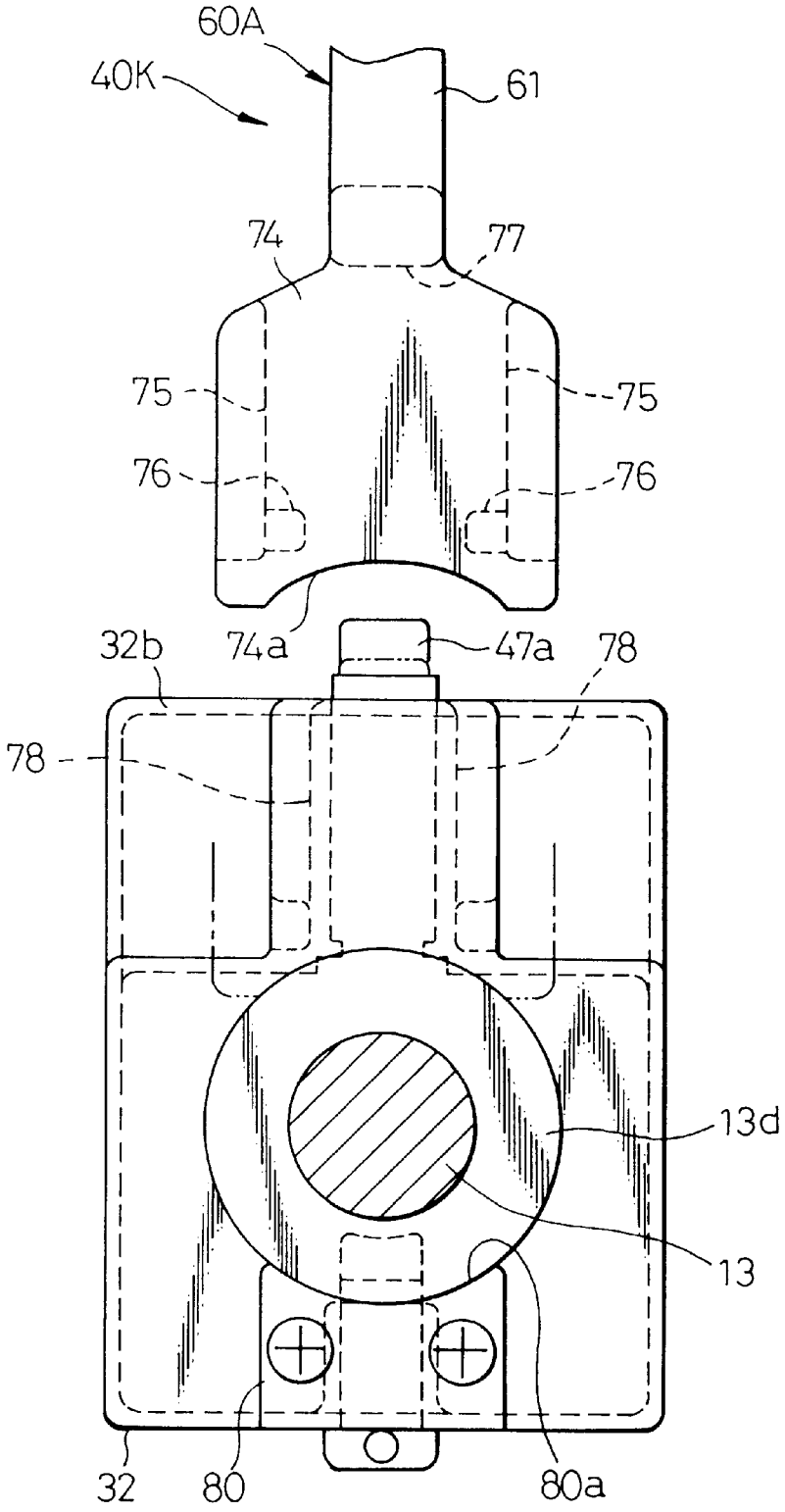
FIG. 31 is a top plan view of the single drive spindle in FIG. 30.
Figure 32:
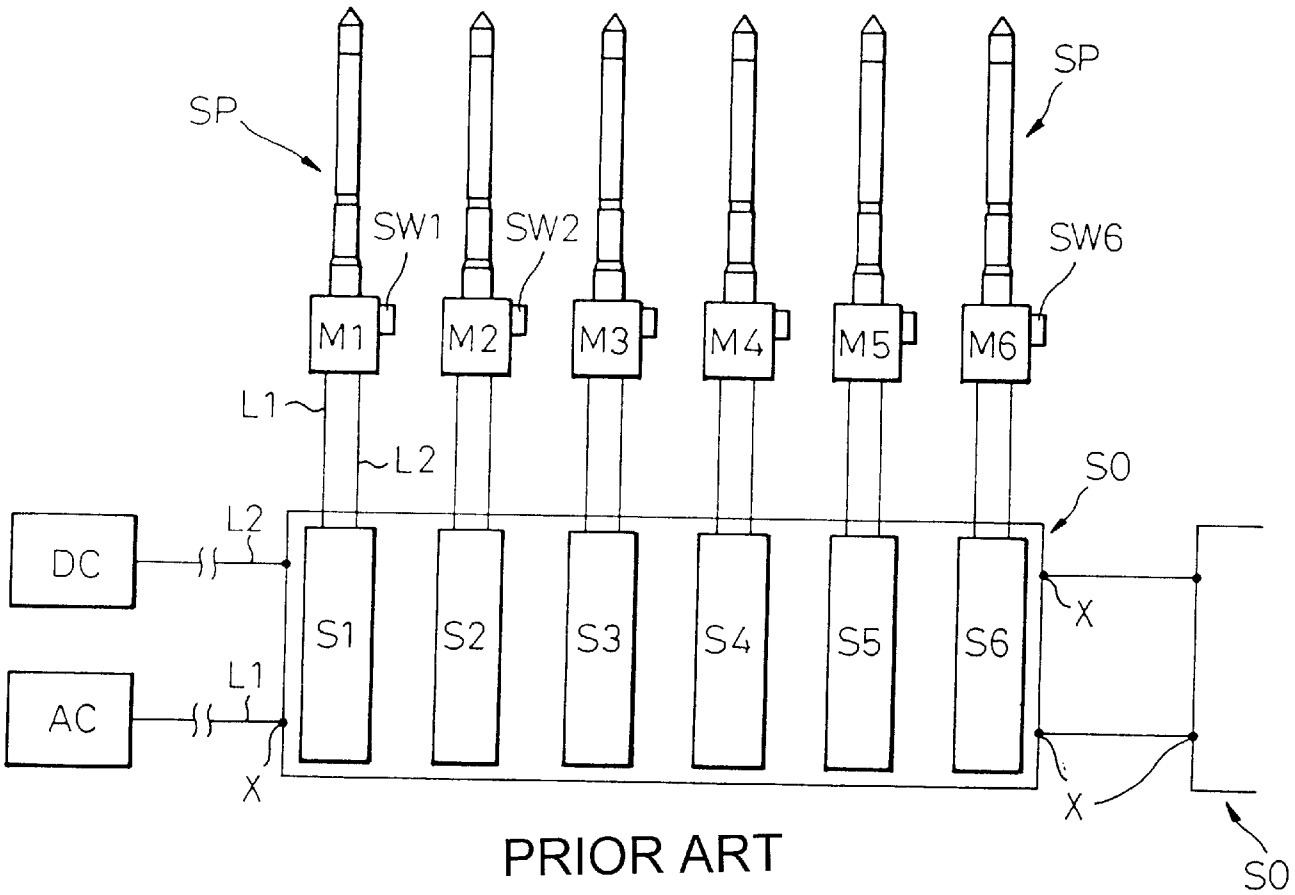
FIG. 32 is an illustration of a prior art.

FIGS. 30 and 31 show a different (tenth) embodiment, wherein a portable braking device 40K has a rear handle portion 61 and a front portion 74 having a width larger than that of the handle portion 61. The front portion 74 has, at its front end surface, an arc shaped surface 74*a* which is adapted to be press contacted with an outer peripheral surface of the flange 13*d* of the spindle shaft 13. The front portion 74 has, at its lower side, bulge portions 75, which are spaced in the direction of the width. A pair of integral engaging pins 76 extend laterally inwardly from the bulge portions 75. The handle part 61 has, at its front bottom, an integral operating part 77 which functions as an operating element for the stop/restart switch 46A.

The stop/restart switch 46A is, similar to the other embodiments, constructed as an alternate type ON-OFF switch and is arranged in the housing 30 part. The switch 46A has a switch button 47A, which extends in a rearward direction. The housing 30 forms, at the rear end adjacent the switch button 47A, a pair of laterally spaced apart horizontal engaging grooves 78 to which the engaging member 76 on the portable braking device 40K is guided and received. The engaging grooves 78 are, at front ends, upwardly bent portions. Furthermore, the cover 32 of the housing 30 has, at its top portion, a stopper 80 which cooperates with the braking device 40K so that the spindle shaft 13 is stopped. The stopper 80 is formed with an arc shaped inner braking surface 80*a*, which faces an outer peripheral surface of the flange part 13*d*. A small clearance $t_0$ is formed between the braking surface 80*a* and the outer peripheral surface of the flange 13*d*. The value of the clearance $t_0$ is smaller than the clearance t between the rotor 21 and the stator 22. The brake operating member 60A is moved, from the side of the switch button 47A, to the spindle shaft 13, so that the braking surface 74*a* of the brake operating member presses the outer peripheral surface of the flange 13*d*, which causes the spindle shaft 13 to be slightly inclined, so that the spindle 13*d* is held between the braking surface 74*a* of the device 40K and the braking surface 80*a* of the stopper 80 at diametrically opposite positions in the peripheral surface of the flange 13*d*. The above mentioned smaller value of the clearance $t_0$ can prevent, in this condition, the rotor 21 contacting the stator 22.

When the operator finds a yarn breakage at a spindle, the operator mounts the portable braking device into the spindle by inserting the engaging pins 76 into the engaging grooves 78. During such a mounting operation, the operating member 77 pushes the switch button 47A, which causes the switch 46 to be made off in a similar manner to the preceding embodiment, which causes the electric drive motor 20 to be de-energized, which causes the motor 20 to continue, for a while, rotating under the effect of momentum.

A further inserted movement of the portable braking device 40K finally causes the engaging members 76 to be fitted to the hooked portions 78*a* of the engaging grooves 78. An upward movement of the handle 61 generates a leverage action about a fulcrum as a contacting point between the engaging member 76 and the hooked portion 78*a*, which causes the braking surface 74*a* to contact the outer peripheral surface of the flange 13, which causes the spindle shaft 13 to be pressed to the braking surface 89 while being slightly inclined. As a result, a braking operation occurs under a condition that the spindle shaft 13 is nipped between the braking surface 74*a* and the braking surface 80*a* which are diametrically opposite with each other. After the stoppage of the spindle, as in the preceding embodiment, the broken yarn is taken out to a position in front of the front roller in a drafting device, the portable braking device is removed, and the stop/start switch 46A is switched from the OFF condition to the ON condition, which allows the electric motor 20 to be fed with power, thereby causing the spindle 13 to rotate, which is followed by a piecing operation.

In the above embodiment where the spindle is supported by using a damper for absorbing vibration during a high speed rotating movement, the stopper is necessary. However, when such damper is eliminated, i.e., in a construction where the single spindle is merely supported by a pair of top and bottom bearing units as, for example, disclosed in Japanese Unexamined Patent Publication (Kokai) No. 5-247738, a provision of such a stopper 80 is unnecessary since, even if the spindle is subjected to single sided loading, the spacing between the rotor and spacer is maintained unchanged.

A stop/restart switch having a normally-open contact may be used for the present invention. For example, it is possible to adapt the device so that the contact is made to open by an operating piece when an actuator shaft is pushed in, and vice versa. While the power supply to the drive motor is controlled by the ON/OFF operation of two phases of the three-phase AC power source in the above embodiments, it is also possible to adapt the device so that the control is carried out by the ON/OFF operation of all of the three phases.

As described above, since the spindle is mechanically braked according to the present invention, it is possible to eliminate at least a DC power source, DC power source lines, electrical joints for the DC power source and a switching circuit between AC and DC power sources which are necessary in the prior art device wherein a DC-brake system is adopted. Thereby, the stop/restart device of the present invention is inexpensive in manufacturing cost and has a high reliability with less electrical trouble even though it requires a mechanical braking mechanism. Since a braking load is applied to both sides of a rotary axis of the spindle shaft to minimize an eccentric component added to the spindle shaft, it is possible to brake the same while maintaining a necessary gap between the rotor and the stator of the drive motor. Particularly, according to a type wherein the braking load is applied to a spindle axis generally transverse thereto, it is possible to reduce a force acted on the spindle bearings and suppress the generation of vibration. Since the braking device is associated with the restart/stop switch, the operability is enhanced. Since the spindle is combined with the braking device and the restart/stop switch as a single unit, the installation thereof to a spinning frame is very easy compared with a case wherein the braking device and the restart/stop switch are separately installed to the spinning frame.

Also, a portable type braking device is usable commonly to a plurality of single drive spindles, whereby the number of parts and troublesome installing operation can be reduced to a great extent compared with a case wherein the braking device is exclusively provided in the respective single drive spindle.

We claim:

1. An apparatus for stopping an independently driven spindle in a spinning machine for yarn comprising a plurality of spindles, each of the plurality of spindles having a spindle shaft and an independent electric drive motor fed by an alternating current power source line, said apparatus including a braking device for executing a mechanical braking operation on the spindle shaft of any one of said plurality of spindles at which a yarn breakage has occurred, and a stop/restart switch for switching on or off the alternating current power source line feeding the drive motor of the one spindle at which the yarn breakage has occurred, wherein said braking device and said stop/restart switch are associated with each other so that operation of one of said braking device and said stop/restart switch operates the other of said braking device and said stop/restart switch.

2. An apparatus for stopping an independently driven spindle as defined by claim 1, wherein the braking device is of a portable type.

3. An apparatus for stopping an independently driven as defined by claim 2, wherein the portable type braking device has an engagement member detachably engageable with the single drive spindle and a brake-operation member having a brake section to be in press contact with the spindle shaft, wherein the brake section is brought into press contact with the spindle shaft while the engagement member is engaged with an engagement section of the single drive spindle.

4. An apparatus for stopping an independently driven spindle as defined by claim 3, wherein the portable type braking device has an actuator section capable of actuating the stop/start switch interposed between the alternating current power source lines and the drive motor when the engagement member is engaged with the single drive spindle.

5. An apparatus for stopping an independently driven spindle in a spinning machine for yarn comprising a plurality of spindles, each of the plurality of spindles having a spindle shaft and an independent electric drive motor fed by an alternating current power source line, said apparatus including a braking device for executing a mechanical braking operation on the spindle shaft of any one of said plurality of spindles at which a yarn breakage has occurred, and a stop/restart switch for switching on or off the alternating current power source line feeding the drive motor of the one spindle at which the yarn breakage has occurred, wherein the construction of said braking device is such that braking is executed by imparting a frictional resistance force transversely to the spindle shaft, and wherein said braking device and said stop/restart switch are associated with each other so that operation of one of said braking device and said stop/restart switch operates the other of said braking device and said stop/restart switch.

6. An apparatus for stopping an independently driven spindle as defined by claim 5, wherein said braking device applies a braking load to the spindle shaft in a direction substantially transverse to a rotating axis of the spindle.

7. An apparatus for stopping an independently driven spindle as defined by any one of claims 1, 5 or 6, wherein the braking device and the stop/start switch are so associated with each other that, when the braking device is actuated, the stop/start switch disconnects the alternating current power source line from the drive motor and the spindle shaft is braked.

8. An apparatus for stopping an independently driven spindle as defined by claim 7, wherein the braking device and the stop/start switch are so associated with each other that, by releasing the braking action of the braking device, the stop/start switch connects the alternating current power source line with the drive motor.

9. A device for stopping/starting a single drive spindle as defined by claim 8, wherein the braking device comprises a brake-operating member moveable between a braking position and a waiting position, a brake section to be brought into press contact with the spindle shaft by the movement of the brake-operating member in the braking direction, and an actuator section for operating the stop/start switch interposed between the alternating current power and source lines and the drive motor.

10. An apparatus for stopping an independently driven spindle as defined by claim 7, wherein the braking device and the stop/start switch are so associated with each other that, even if the braking action of the braking device is released, the stop/start switch holds the disconnection of the alternating current power source line with the drive motor, and thereafter, by returning the braking device to a waiting position, the stop/start switch connects the alternating current power source line with the drive motor.

11. A device for stopping/starting a single drive spindle as defined by claim 10, wherein the braking device comprises a brake-operating member moveable between a braking position and the waiting position, a brake section to be brought into press contact with the spindle shaft by the movement of the brake-operating member in the braking direction, and an actuator section for operating the stop/start switch interposed between the alternating current power and source lines and the drive motor.

12. An apparatus for stopping an independently driven spindle as defined by claim 7, wherein the braking device comprises a brake-operating member movable between a braking position and a waiting position, a brake section to be brought into press contact with the spindle shaft by the movement of the brake-operating member in the braking direction, and an actuator section for operating the stop/start switch interposed between the alternating current power source line and the drive motor.

13. A single drive spindle used for a spinning frame, comprising a housing, a drive motor housed in said housing for driving a spindle shaft of the spindle, a braking device for mechanically braking the spindle shaft and a stop/start switch for opening/closing the connection between the drive motor and an alternating current power source line, wherein said braking device and said stop/restart switch are associated with each other so that operation of one of said braking device and said stop/restart switch operates the other of said braking device and said stop/restart switch.

14. A single drive spindle used for a spinning frame, comprising a housing, a drive motor housed in said housing for driving a spindle shaft of the spindle, a braking device for mechanically braking the spindle shaft and a stop/start switch for opening/closing the connection between the drive motor and an alternating current power source line, wherein the braking device and the stop/start switch are so associated with each other that, by actuating the braking device, the stop/start switch disconnects the alternating current power source line from the drive motor and the spindle is braked, and, by releasing the braking action of the braking device, the stop/start switch connects the alternating current power source line with the drive motor.

15. A single drive spindle used for a spinning frame, comprising a housing, a drive motor housed in said housing for driving a spindle shaft of the spindle, a braking device for mechanically braking the spindle shaft and a stop/start switch for opening/closing the connection between the drive motor and an alternating current power source line, wherein the braking device and the stop/start switch are so associated with each other that, by actuating the braking device, the stop/start switch disconnects the alternating current power source line from the drive motor and the spindle is braked, the disconnection of the alternating current power source line being held by the stop/start switch even if the braking action of the braking device is released, and thereafter, by returning the braking device to a waiting position, the stop/start switch connects the alternating current power source line with the drive motor.

16. A single drive spindle as defined by claim 15, wherein the braking device comprises a brake-operating member movable between a braking position and the waiting position, a brake section to be brought into press contact with the spindle shaft by the movement of the brake-operating member to the braking position, and an actuator section for operating the stop/start switch interposed between the alternating current power source line and the drive motor, wherein the actuator section holds the stop/start switch in the OFF state to disconnect the alternating current power line from the drive motor even if the braking action due to the brake section is released, and, by the return of the brake-operating member to the waiting position, cancels the holding action of the stop/start switch.

17. A single drive spindle as defined by claim 16, wherein the brake-operating member has a bifurcated front end nipping the spindle shaft and is mounted to the housing and is rotatable upward and downward, and the brake sections provided at the front end of the brake-operating member are brought into contact with a flange of the spindle shaft to apply a downward pressure onto an upper surface thereof in the axial direction of the spindle shaft.

* * * * *

UNITED STATES PATENT AND TRADEMARK OFFICE

CERTIFICATE OF CORRECTION

PATENT NO. : 6,047,534
DATED : April 11, 2000
INVENTOR(S) : Yutaka TANAKA et al.

It is certified that error appears in the above-identified patent and that said Letters Patent is hereby corrected as shown below:

Claim 3, col. 22, line 8, after "driven", insert --spindle--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*